US009453455B2

(12) United States Patent
Lewis et al.

(10) Patent No.: US 9,453,455 B2
(45) Date of Patent: Sep. 27, 2016

(54) SYSTEM FOR REGULATING COOLANT FLOW IN AN ENGINE

(71) Applicant: Stant USA Corp., Connersville, IN (US)

(72) Inventors: Carl R Lewis, Connersville, IN (US); J Bradley Groom, Oxford, OH (US)

(73) Assignee: Stant USA Corp., Connersville, IN (US)

( * ) Notice: Subject to any disclaimer, the term of this patent is extended or adjusted under 35 U.S.C. 154(b) by 154 days.

(21) Appl. No.: 14/340,804

(22) Filed: Jul. 25, 2014

(65) Prior Publication Data

US 2015/0027386 A1 Jan. 29, 2015

Related U.S. Application Data

(60) Provisional application No. 61/858,552, filed on Jul. 25, 2013.

(51) Int. Cl.
*F01P 7/14* (2006.01)
*F01P 7/16* (2006.01)

(52) U.S. Cl.
CPC ..... *F01P 7/16* (2013.01); *F01P 7/167* (2013.01); *F01P 2007/143* (2013.01); *F01P 2007/146* (2013.01); *F01P 2025/62* (2013.01); *F01P 2060/08* (2013.01)

(58) Field of Classification Search
CPC ..... F02P 7/16; F02P 2007/146; F01P 7/167; F01P 2060/08; F01P 2025/62; F01P 7/14; F01P 7/165
USPC ..... 123/41.1
See application file for complete search history.

(56) References Cited

U.S. PATENT DOCUMENTS

| | | | | |
|---|---|---|---|---|
| 4,053,105 | A | 10/1977 | Wong et al. | |
| 4,164,322 | A | 8/1979 | Wong et al. | |
| 4,280,655 | A | 7/1981 | Duprez et al. | |
| 4,286,750 | A | 9/1981 | Wong et al. | |
| 4,562,953 | A | 1/1986 | Duprez et al. | |
| 4,763,834 | A | 8/1988 | Duprez | |
| 5,381,952 | A | 1/1995 | Duprez | |
| 5,410,991 | A | 5/1995 | Beaudry et al. | |
| 5,967,101 | A * | 10/1999 | Roth | F01P 7/16 123/41.1 |
| 6,742,716 | B1 | 6/2004 | Duprez et al. | |
| 6,764,020 | B1 | 7/2004 | Zhao et al. | |
| 2013/0019819 | A1 * | 1/2013 | Dye | F01P 7/165 123/41.09 |

FOREIGN PATENT DOCUMENTS

| | | |
|---|---|---|
| WO | 9711262 A1 | 3/1997 |

* cited by examiner

*Primary Examiner* — Lindsay Low
*Assistant Examiner* — Charles Brauch
(74) *Attorney, Agent, or Firm* — Barnes & Thornburg LLP

(57) ABSTRACT

A fluid regulator for an engine coolant system includes a thermostat. The thermostat is configured to route engine coolant through an engine and a radiator in one mode and through the engine to bypass the radiator in another mode.

18 Claims, 14 Drawing Sheets

SYSTEM FOR REGULATING COOLANT FLOW IN AN ENGINE

PRIORITY CLAIM

This application claims priority under 35 U.S.C. §119(e) to U.S. Provisional Application Ser. No. 61/858,552, filed Jul. 25, 2013, which is expressly incorporated by reference herein.

BACKGROUND

The present disclosure relates to thermostats, and in particular to thermostats for regulating coolant flow in a vehicle engine. More particularly, the present disclosure relates to bypass systems for causing flow of engine coolant to bypass a radiator in a vehicle engine cooling system.

A radiator is a heat exchanger that is included in a vehicle engine cooling system. Engine coolant is a liquid that is heated as it is pumped through conduits provided in an engine block. The engine block is cooled because heat from the engine block is transferred to the engine coolant flowing through the hot engine block. The hot engine coolant is then cooled as it flows through a radiator designed to transfer heat from the hot flowing coolant to the atmosphere. It is desirable to block circulation of engine coolant through a radiator during, for example, an engine start-up cycle when the coolant is cold and therefore does not need to be cooled.

SUMMARY

A fluid regulator in accordance with the present disclosure includes a fluid-control housing and a fluid—flow controller in the fluid-control housing. The fluid-control housing is formed to include a fluid-transfer passageway through which engine coolant can flow to reach a radiator and a radiator-bypass passageway through which engine coolant can flow to pass through a vehicle engine without passing through the radiator.

In illustrative embodiments, the fluid-flow controller is configured to circulate most of the engine coolant through a bypass loop to cause engine coolant to flow through the engine yet bypass the radiator when the engine coolant is relatively cold but warming in the early stages of an engine start-up cycle. In accordance with the present disclosure, some of the warming engine coolant circulating in the bypass loop and passing through the engine is diverted from that bypass loop and caused to flow through a radiator warm-up passageway into a radiator supply loop and through the radiator so as to warm up the radiator and any reserve engine coolant stored in the radiator before the bypass loop is closed and all of the engine coolant is caused to flow in the radiator loop.

In illustrative embodiments, the fluid-flow controller includes a radiator bypass thermostat configured to sense the temperature of engine coolant discharged from an engine and to divert coolant into a bypass loop during engine start-up and then, when the engine coolant is hot, into a radiator loop so that the hot engine coolant is cooled as it passes through the radiator. The radiator bypass thermostat is located in a fluid-transfer passageway provided in a fluid-control housing of a fluid regulator included in an engine coolant system. The radiator bypass thermostat includes a temperature-responsive bypass valve that is arranged to move in the fluid-transfer passageway between a radiator-bypass position and a radiator-supply position. At engine start-up, the engine is cold and the bypass valve is exposed to cold engine coolant present in the fluid-transfer passageway and is urged by a valve-mover spring to the radiator-bypass position to divert flow of cold engine coolant into the radiator-bypass passageway for return to the vehicle engine. Thus, the engine coolant is circulated in the bypass loop and through the engine so that it can warm up and is not passed through the radiator while it is cold. When exposed to hot engine coolant flowing in the fluid-transfer passageway, the temperature-responsive bypass valve is configured to move automatically against the valve-mover spring to the radiator-supply position in the fluid-transfer passageway to close the radiator-bypass passageway and open a radiator loop to cause the hot engine coolant to flow through the radiator where it is cooled before the engine coolant is returned to the engine.

In illustrative embodiments, the fluid-flow controller also includes a radiator warm-up thermostat located in the radiator-bypass passageway and configured to divert some of the engine coolant circulating in the bypass loop at engine start-up into the radiator to warm up the radiator. The fluid-control housing is also formed to include a radiator warm-up passageway having an outlet communicating with the fluid-transfer passageway at a point downstream from the radiator bypass thermostat and upstream from the radiator. The radiator warm-up thermostat includes a temperature-responsive warm-up valve that is arranged to move in the radiator-bypass passageway to divert a small BLEED amount initially (and increasingly larger amounts later) of warming engine coolant from the radiator-bypass passageway in the bypass loop so it can flow through the radiator warm-up passageway past the radiator bypass thermostat into a downstream section of the fluid-transfer passageway in the radiator loop to reach and flow through and begin to warm up the radiator before the temperature-responsive bypass valve in the radiator bypass thermostat is moved to the radiator-supply position once the engine coolant has been heated by the vehicle engine to the predetermined hot temperature.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 illustrates a COLD-START phase of an engine start-up cycle for a vehicle engine system in accordance with the present disclosure in which a temperature-responsive bypass valve in the radiator bypass thermostat is in a BYPASS position and a temperature-responsive warm-up valve in the radiator warm-up thermostat is in a BLEED position;

FIG. 5 illustrates an EARLY WARM-UP phase of an engine-start cycle for a vehicle engine system in accordance with the present disclosure in which the temperature-responsive bypass valve of the radiator bypass thermostat remains in the BYPASS position while the temperature-responsive warm-up valve of the radiator warm-up thermostat is now in the LOW (flow) position;

FIG. 6 illustrates a LATE WARM-UP phase of an engine-start cycle for a vehicle engine system in accordance with the present disclosure in which the temperature-responsive bypass valve of the radiator bypass thermostat remains in the BYPASS position while the temperature-responsive warm-up valve of the radiator warm-up thermostat is now in the HIGH (flow) position;

FIG. 7 illustrates a first NORMAL (low-temperature) phase of an engine-operation cycle for a vehicle engine system in accordance with the present disclosure in which the temperature-responsive bypass valve is now in a SPLIT position to allow engine coolant to flow through each of the radiator bypass and the radiator supply zones while the temperature-responsive warm-up valve of the radiator warm-up thermostat remains in the HIGH (flow) position;

FIG. 8 illustrates a second NORMAL (medium-temperature) phase of an engine-operation cycle for a vehicle engine system in accordance with the present disclosure in which the temperature-responsive bypass valve of the radiator bypass thermostat remains in a SPLIT position and the temperature-responsive warm-up valve of the radiator warm-up thermostat is now in an OVER-TRAVEL position;

FIG. 9 illustrates a third NORMAL (hot-temperature) phase of an engine-operation cycle for a vehicle engine system in accordance with the present disclosure in which the temperature-responsive bypass valve in the radiator bypass thermostat is now in a COOL position to cause all engine coolant exiting the engine to flow through the radiator before it is returned to the engine while the temperature-responsive warm-up valve of the radiator warm-up thermostat has been returned to the BLEED position so that it is ready for the next engine start-up cycle;

DETAILED DESCRIPTION

Figure 1:
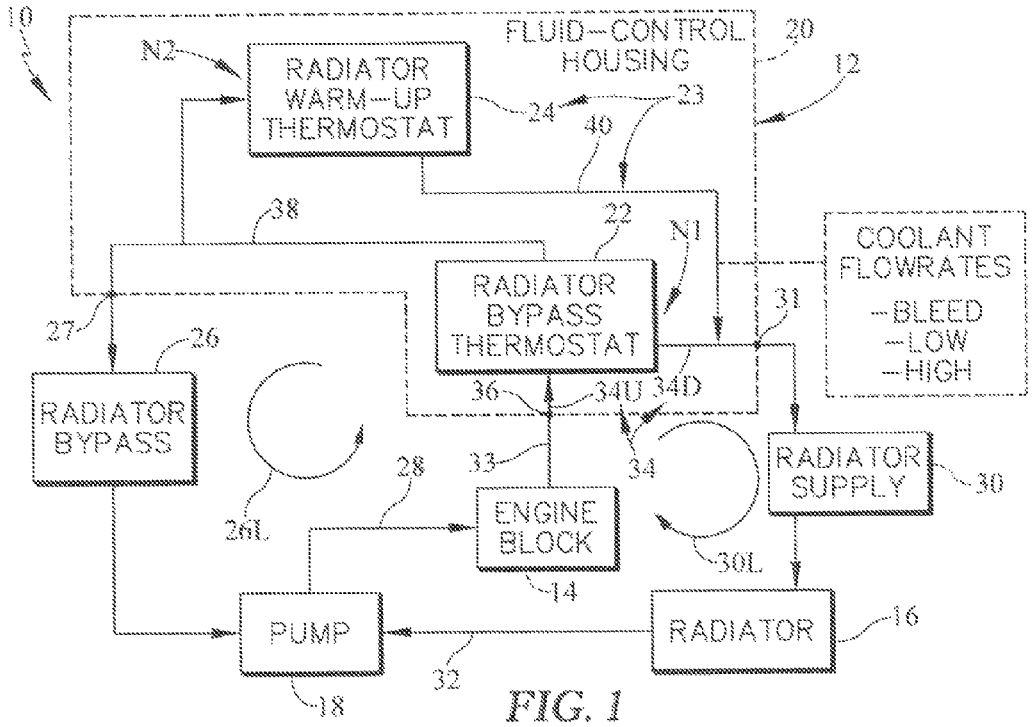
FIG. 1 is a diagrammatic view of a vehicle engine system including an engine, a radiator, a pump, a fluid-control housing containing a radiator bypass thermostat and a radiator warm-up thermostat, a radiator bypass for conducting cold engine coolant from a radiator bypass passageway formed in the fluid-control housing to the pump for delivery to the engine during an early stage of an engine start-up cycle, and a radiator supply for conducting engine coolant provided initially by the radiator warm-up thermostat and later by the radiator bypass thermostat to the radiator for delivery to the pump and subsequent delivery to the engine and suggesting that the radiator bypass thermostat is placed in a fluid-transfer passageway interconnecting the engine and the radiator supply and suggesting that the radiator warm-up thermostat is placed in a radiator-bypass passageway interconnecting the radiator bypass thermostat and the radiator bypass and suggesting that a small amount of warming engine coolant circulating through the engine in a radiator bypass loop can be diverted from the radiator-bypass passage by the radiator warm-up thermostat to flow through a radiator warm-up passageway interconnecting the radiator warm-up thermostat and a downstream section of the fluid-transfer passageway downstream from the radiator bypass thermostat to flow into and through the radiator supply to reach and flow through and warm up the radiator during an early stage of an engine start-up cycle.

An engine coolant system 10 in accordance with the present disclosure includes a fluid regulator 12, an engine 14, a radiator 16, and a fluid pump 18 a shown diagrammatically in FIG. 1. Fluid regulator 12 includes a fluid-control housing 20 and a fluid-flow controller 23 comprising a radiator bypass thermostat 22 and a radiator warm-up thermostat 24 as suggested diagrammatically in FIG. 1 and illustratively in FIGS. 3 and 10-13. Engine coolant is the fluid regulated by fluid regulator 12 in illustrative embodiments of the present disclosure. Radiator warm-up thermostat 24 is used in accordance with the present disclosure to supply a metered flow of engine coolant to radiator 16 to warm up the radiator 16 in the early stages of an engine start-up cycle before the radiator bypass thermostat 22 is used to cause all of the engine coolant to flow through radiator 16.

Figure 10:
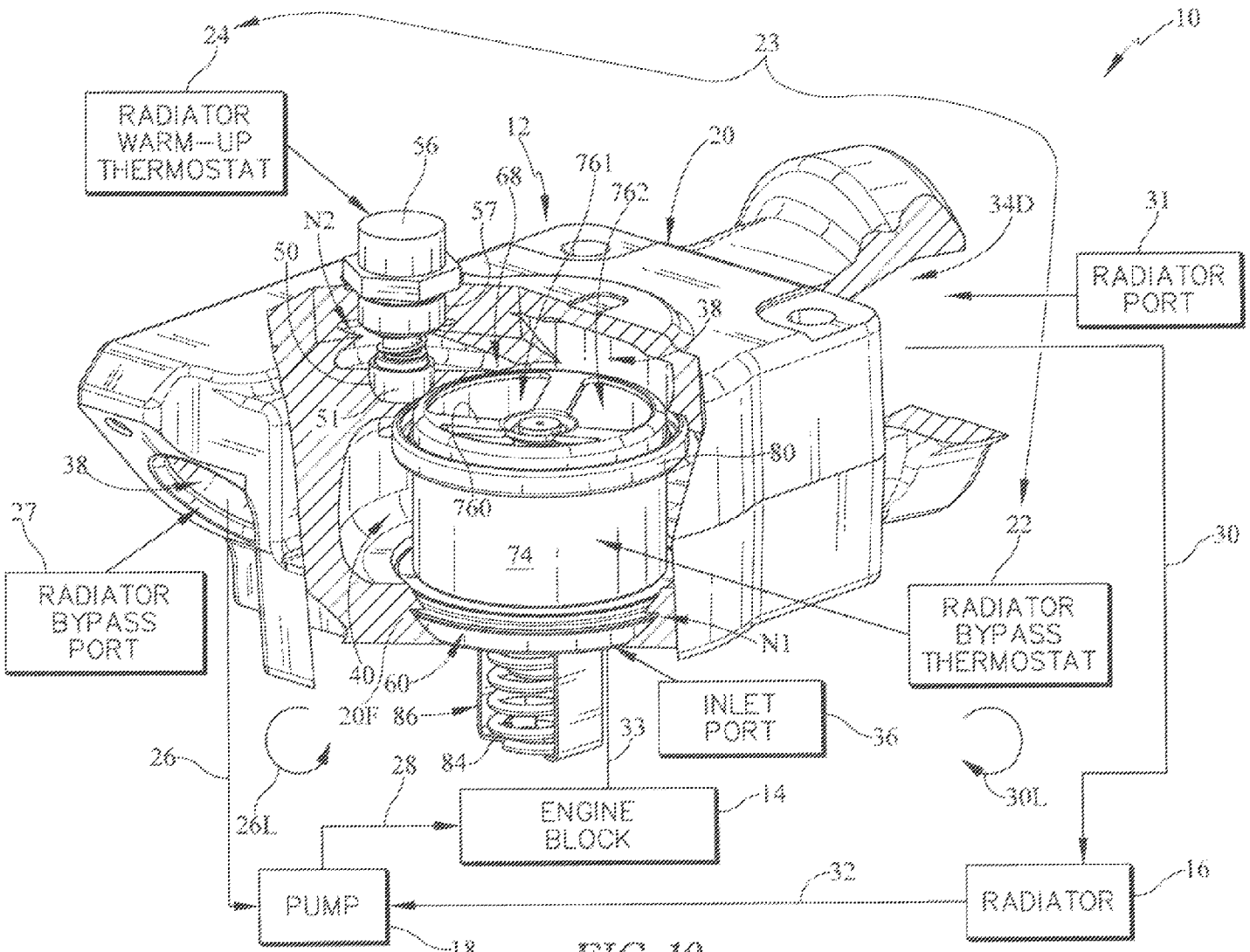
FIG. 10 is an assembled view of the fluid regulator of FIG. 2 with portions broken away to show the radiator warm-up thermostat and the radiator bypass thermostat.

Fluid regulator 12 is provided for use in an engine coolant system 10 including a radiator loop 30L comprising an engine 14 and a radiator 16 and a bypass loop 26L comprising the engine 14 and excluding radiator 16 as suggested diagrammatically in FIG. 1 and illustratively in FIG. 10. Radiator bypass thermostat 22 is located at a first thermostat node N1 provided in radiator loop 30L in fluid-control housing 20 to direct flow of engine coolant through bypass loop 26L until engine coolant at first thermostat node N1 rises to a predetermined temperature and flow of engine coolant is directed through radiator loop 30L. Radiator warm-up thermostat 24 is located at a second thermostat node N2 in a radiator bypass-passageway 38 formed in fluid-control housing 20 and included in bypass loop 26L. Radiator warm-up thermostat 24 is configured to provide means for diverting some of the engine coolant flowing in the radiator bypass passageway 38 at the second thermostat node N2 into a radiator warm-up passageway 40 formed in the fluid-control housing 20 and coupled in fluid communication to a portion of the radiator loop 30L formed in the fluid-control housing 20 to cause that diverted engine coolant to flow through the radiator loop 30L and pre-warm the radiator 16 while most of the engine coolant is circulating in the bypass loop 26L.

Engine coolant system 10 further includes a radiator bypass 26 for conducting relatively cool engine coolant from a radiator bypass port 27 formed in fluid-control housing 20 to fluid pump 18 and a coolant return 28 for conducting pressurized engine coolant discharged by fluid pump 18 to engine 14 as suggested diagrammatically in FIG. 1. During an engine start-up cycle, radiator bypass thermostat 22 is used to divert engine coolant flowing in fluid-control housing 20 into radiator bypass 26 so that it can be pumped into engine 14 and circulate in a bypass loop 26L to flow through engine 14 without flowing through radiator 16 to allow heat in engine 14 to be transferred to engine coolant circulating in bypass loop 26L.

Engine coolant system 10 further includes a radiator supply 30 for conducting warm and hot engine coolant from a radiator port 31 formed in fluid-control housing 20 to radiator 16 as suggested diagrammatically in FIG. 1. Engine coolant system 10 also includes a pump supply conduit 32 interconnecting pump 18 and engine 14 and a thermostat supply conduit 33 interconnecting engine 14 and fluid-control housing 20. Pump supply conduit 32 conducts cooled engine coolant from radiator 16 to fluid pump 18 so that the cooled engine coolant can be pumped through coolant return 28 into and through engine 14 and then through thermostat supply conduit 33 into fluid-control housing 20 so that the hot engine coolant can circulate in a radiator loop 30L communicating with engine 14 and radiator 16. Heat in engine 14 is transferred to engine coolant circulating in radiator loop 30L and then heat in engine coolant passing through radiator 16 is transferred to the atmosphere surrounding radiator 16.

Fluid-control housing 20 is formed to include a fluid-transfer passageway 34 for conducting engine coolant from an inlet port 36 formed in fluid-control housing 20 and coupled to thermostat supply conduit 33 to the radiator port 31 formed in fluid-control housing 20 as suggested diagrammatically in FIG. 1. Radiator bypass thermostat 22 is located at a first thermostat node N1 provided in fluid-transfer passageway 34 and in communication with radiator-bypass passageway 38. Radiator bypass thermostat 22 is arranged to communicate with and regulate flow of engine coolant flowing through fluid-transfer passageway 34 from inlet port 36 to radiator port 31 as suggested diagrammatically in FIG. 1. Fluid-transfer passageway 34 is included in radiator loop 30L. Fluid-transfer passageway 34 includes an upstream section 34U interconnecting inlet port 36 and radiator bypass thermostat 22 in fluid communication and a downstream section 34D interconnecting radiator bypass thermostat 22 and radiator port 31 in fluid communication. Thermostat supply conduit 33 interconnects engine 14 and downstream section 34D of fluid-transfer passageway 34 in fluid communication.

A radiator-bypass passageway 38 is formed in fluid-control housing 20 to interconnect radiator bypass thermostat 22 and radiator bypass port 27 in fluid communication as suggested diagrammatically in FIG. 1. Radiator-bypass passageway 38 is included in bypass loop 26L. Radiator warm-up thermostat 24 is located at a second thermostat node N2 provided in radiator bypass passageway 38 and is arranged to communicate with and regulate flow of engine coolant flowing through radiator-bypass passageway 38 as suggested diagrammatically in FIG. 1.

A radiator warm-up passageway 40 is formed in fluid-control housing 20 to interconnect radiator warm-up thermostat 24 and downstream section 34D of fluid-transfer passageway 34 in fluid communication as suggested diagrammatically in FIG. 1. During early stages of an engine start-up cycle, radiator warm-up thermostat 24 is used to siphon off some of the relatively cool but warming engine coolant that is flowing through radiator-bypass passageway 38 and circulating in bypass loop 26L and cause it to flow (in series) through radiator warm-up passageway 40, a portion of downstream section 34D of fluid-transfer passageway 34, and radiator supply 30 into and through radiator 16 to warm up radiator 16 and any reserved engine coolant in radiator 16.

Fluid regulator 12 is configured to divert some of the warming engine coolant that is circulating in bypass loop 26L during an early stage of an engine start-up cycle through radiator warm-up passageway 40 and downstream section 34D of fluid-transfer passageway 34 formed in fluid-control housing 20 to the radiator 16 to warm up the radiator 26 before engine coolant exposed to radiator bypass thermostat 22 is determined to be hot enough by radiator bypass thermostat 22 to circulate in radiator loop 30L and be cooled as it passes through radiator 26 before it is returned to engine 14. Radiator warm-up thermostat 24 provides temperature-responsive means for diverting a variable flow of engine coolant from radiator-bypass passageway 38 to radiator warm-up passageway 40 when engine coolant is circulating mainly in bypass loop 26L. This will cause a small amount of radiator-warming engine coolant to circulate in radiator loop 30L during an early stage of an engine start-up cycle while most of the engine coolant is circulating in the bypass loop 26L. Once the engine coolant circulating in bypass loop 26L is hot enough and radiator 16 has been pre-warmed, radiator bypass thermostat 22 is actuated and all of the engine coolant circulating in engine coolant system 10 is circulated in radiator loop 30L to transfer engine heat to the atmosphere via the engine coolant and radiator 16.

Engine coolant system 10 is thus configured in accordance with the present disclosure to avoid operating conditions in which the main thermostat flow control offered by radiator bypass thermostat 22 is too coarse to create a condition in which too much engine coolant is allowed to flow to radiator 16 upon initial actuation of radiator bypass thermostat 22 to close bypass loop 26L and open radiator loop 30L. In such an undesirable situation, the radiator would send too large a volume of cold coolant back to the engine and cause radiator bypass thermostat 22 to close. An unexpected cycle of opening and closing of radiator bypass thermostat 22 could occur during engine start-up cycles and cause large pressure and temperature fluctuations in the radiator leading to premature failure. By using radiator warm-up thermostat 24 to open and close a radiator warm-up passageway communicating with radiator loop 30L upstream of radiator 16 and allowing warming engine coolant circulating in bypass loop 26L to flow into and circulate in radiator loop 30L, the amount of initial flow of cold coolant to the radiator is managed to minimize thermal shock to the radiator during an engine start-up cycle. Radiator warm-up thermostat 24 opens at a slightly lower engine-coolant temperature than the main radiator bypass thermostat 22 to ensure that a stabilizing flow of warming engine coolant through radiator 16 is established before actuation of the main radiator bypass thermostat 22 to cause engine coolant to circulate only in radiator loop 30L.

Engine coolant system 10 includes engine 14, radiator 16, pump 18, and a main (radiator bypass) thermostat 22 as suggested in FIG. 1. Engine 14 generates heat during operation that is passed to engine coolant flowing through engine 14. Radiator 16 receives the coolant before returning the coolant to the engine 14 during normal engine operation. Pump 18 pressurizes the engine coolant circulating in both the bypass loop 26L and the radiator loop 30L in engine coolant system 10 so that the engine coolant flows through engine 14 and radiator 16. Main (radiator bypass) thermostat 22 controls circulation of coolant through engine 14 and radiator 16 based on temperature of coolant sensed by radiator bypass thermostat 22 to cause the coolant to bypass radiator 16 and circulate in a bypass loop 26L when engine 14 is relatively cool (for example, during engine warm-up) and to cause engine coolant to be passed through radiator 16 in a radiator supply loop 30L when engine 14 is relatively warm (for example, during normal operation) so that engine 14 is operated generally within a predetermined temperature band corresponding to efficient combustion in engine 14.

Radiator bypass thermostat 22 controls a relatively high-volume primary flow of engine coolant from engine 14 to radiator 16 during normal engine operation when engine coolant is hot and needs to be cooled in radiator 16 before it is returned to engine 14. Radiator bypass thermostat 22 communicates with engine 14 flowing in fluid-transfer passageway 34 formed in fluid-control housing 20 of fluid regulator 12 between inlet port 36 and radiator port 31 as suggested in FIG. 1.

Radiator warm-up thermostat 24 controls a relatively low-volume secondary flow of engine coolant from engine 14 to radiator 16 during an early stage of an engine start-up cycle. This secondary flow of engine coolant is used to warm up reserve coolant stored in radiator 16 before engine 14 reaches a normal operating temperature so that radiator 16 is not thermally shocked with relatively hot coolant upon flow of hot engine coolant in radiator loop 30L when normal engine operating temperature is reached.

Figure 1A:
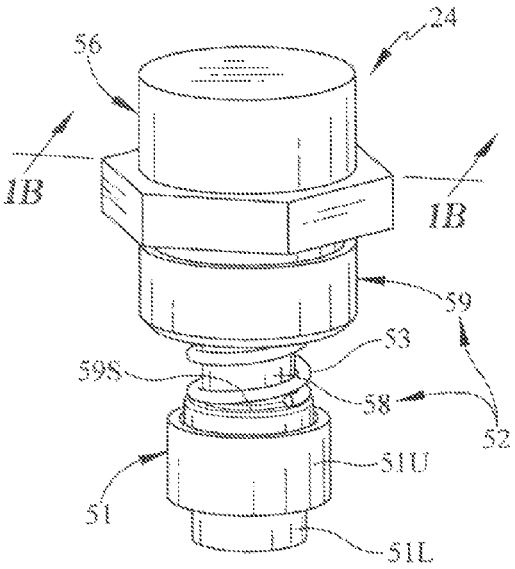
FIG. 1A is an enlarged perspective view of an illustrative embodiment of the radiator warm-up thermostat of FIG. 1.
Figure 1B:
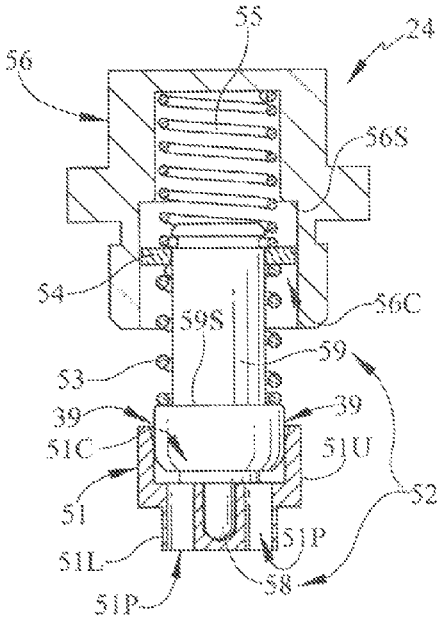
FIG. 1B is a sectional view taken along line 1B-1B of the radiator warm-up thermostat of FIG. 1.
Figure 2:
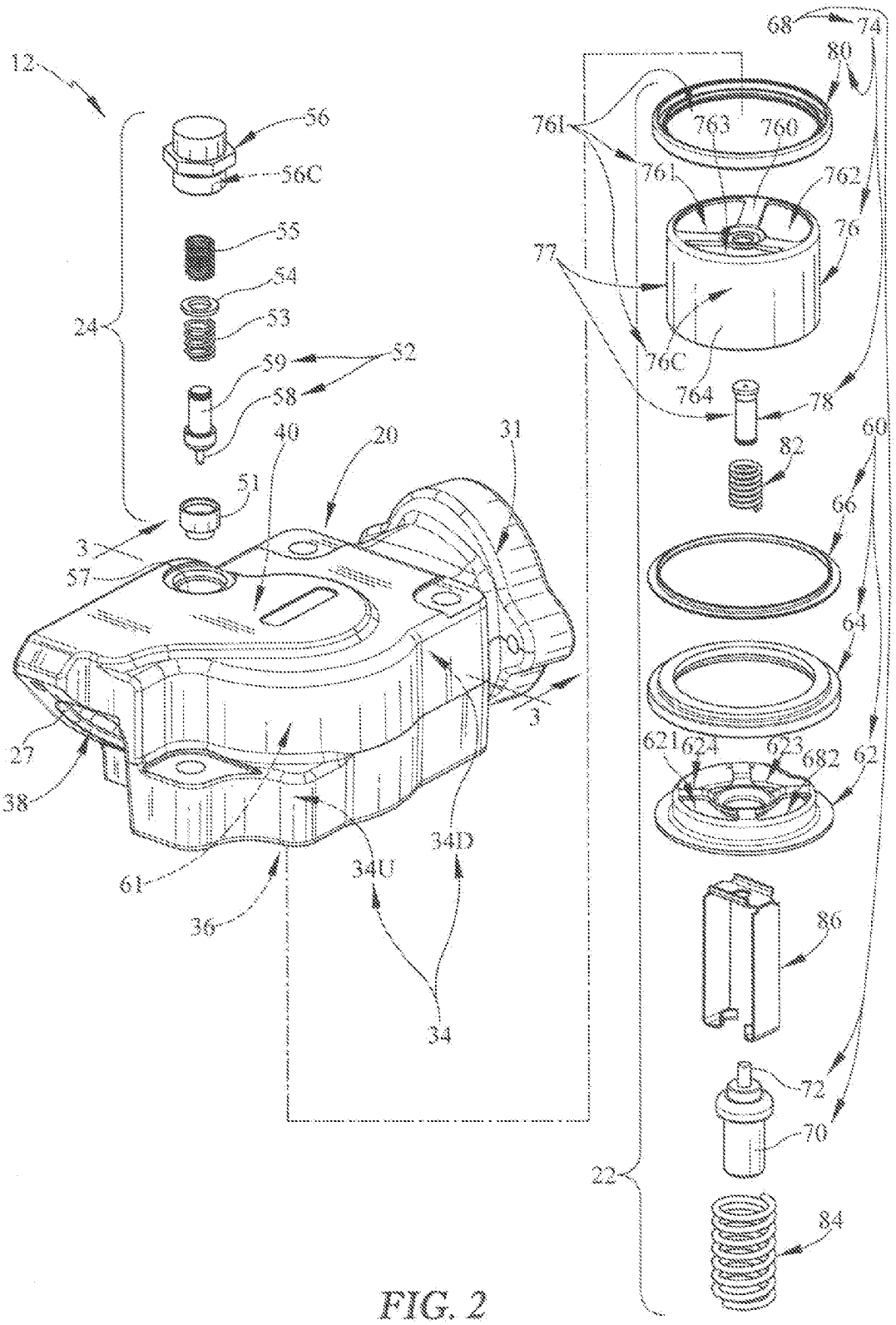
FIG. 2 is a perspective view of an illustrative fluid regulator in accordance with the disclosure showing an illustrative fluid-control housing and exploded perspective assembly views of an illustrative radiator bypass thermostat (on the right) and an illustrative radiator warm-up thermostat (on the left)
Figure 3:
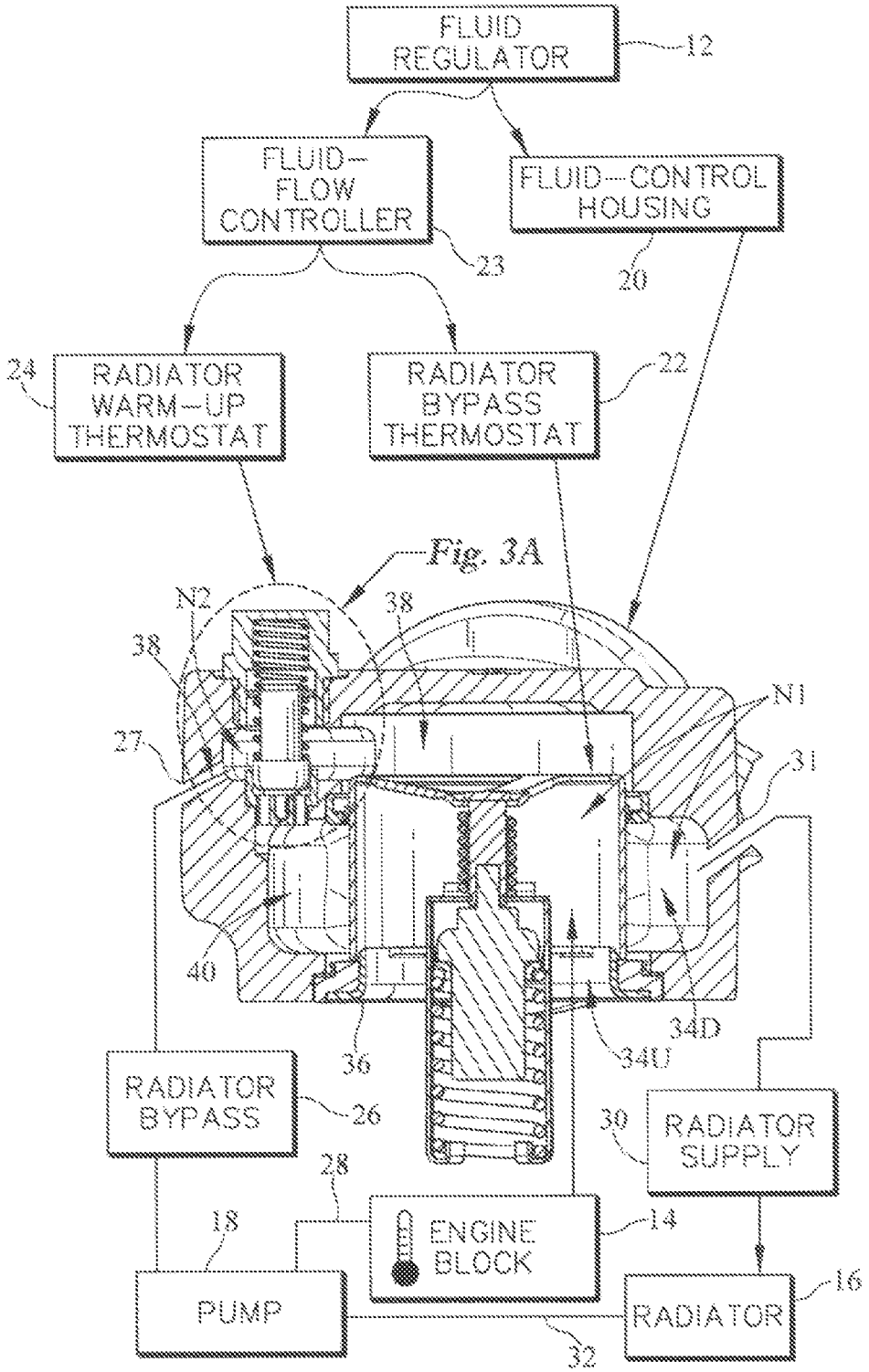
FIG. 3 is an enlarged sectional view taken generally along line 3-3 of FIG. 2 (after assembly and installation of the thermostats in the flow-control housing) showing placement of a relatively large radiator bypass thermostat in a fluid-transfer passageway formed in the fluid-control housing to interconnect the engine and the radiator supply and showing placement of a relatively smaller radiator warm-up thermostat in a radiator-bypass passageway formed in the fluid-control housing to interconnect the radiator bypass thermostat and the radiator bypass and showing the radiator bypass thermostat in a radiator-bypass mode blocking flow of engine coolant to the radiator supply and diverting flow of engine coolant into the radiator-bypass passageway so that most engine coolant flows to the radiator bypass and some engine coolant can flow to the radiator warm-up thermostat to be diverted in varying flow volumes into the radiator warm-up passageway as suggested in FIGS. 3A-3D for delivery to the radiator supply to reach and warm up the radiator before the engine coolant is heated in the engine to a temperature that is hot enough to change the radiator bypass thermostat to a radiator supply mode.
Figure 3A:
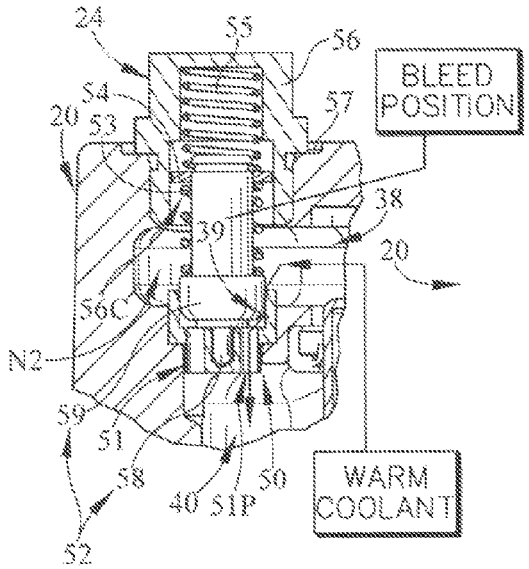
FIG. 3A is an enlarged view of the radiator warm-up thermostat taken from the circled region in FIG. 3 showing movement of a temperature-responsive warm-up valve to a default BLEED position at engine start-up when relatively cold engine coolant flows through the radiator-bypass passageway so that only a small stream of engine coolant is diverted from the radiator-bypass passageway to the radiator via the radiator warm-up passageway.
Figure 3B:
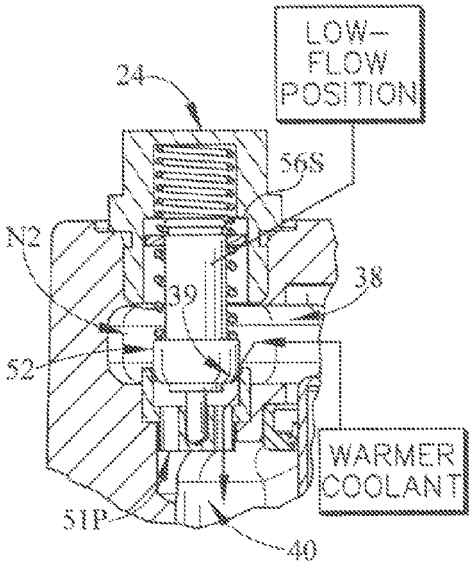
FIG. 3B is a view similar to FIG. 3A showing movement of the temperature-responsive warm-up valve to a low-flow position when relatively warm coolant is passed through the radiator-bypass passageway so that a relatively larger stream of warm engine coolant is diverted from the radiator-bypass passageway to the radiator via the radiator warm-up passageway.
Figure 4:
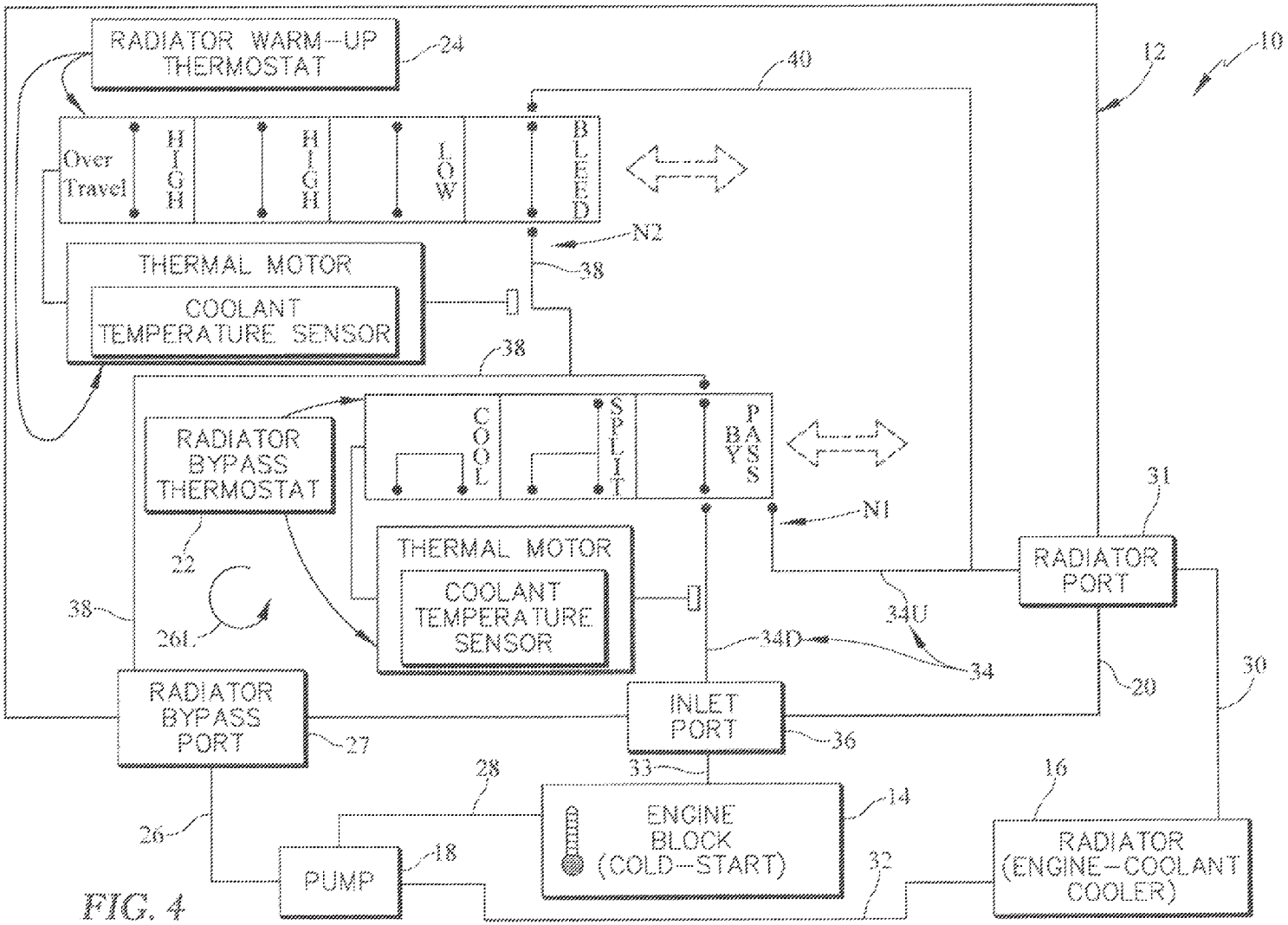
FIGS. 4-9 are diagrammatic views of a vehicle engine system in accordance with the present disclosure illustrating operation of the radiator warm-up thermostat to warm the radiator during early stages of an engine-start cycle before the radiator bypass thermostat is changed from a radiator bypass mode to a radiator supply mode to cause all engine coolant flowing through the engine to flow through the radiator.

Radiator warm-up thermostat 24 is shown illustratively in FIGS. 1A, 1B, and 2 and diagrammatically in FIG. 4. As suggested in FIGS. 2 and 3A, radiator warm-up thermostat 24 includes an orifice insert 51 sized to mount in a stationary position in an orifice 50 formed in fluid-control housing 20 to interconnect radiator bypass passageway 38 and radiator warm-up passageway 40. As suggested in FIG. 2, radiator warm-up thermostat 24 also includes a temperature-responsive warm-up valve 52, an over-travel spring 53, a movable spring perch 54, a valve-mover spring 55, and a housing-mount cap 56 sized to mount in a stationary position in a thermostat-receiver aperture 57 formed in fluid-control housing 20. In an illustrative embodiment, temperature-responsive warm-up valve 52 includes a piston 58 and a thermal (e.g., wax) motor 59 coupled to piston 58 as suggested in FIG. 1B. Orifice insert 51 is formed to include at least one coolant-flow passageway 51P through which engine coolant can flow from radiator bypass passageway 38 into radiator warm-up passageway 40 as suggested in FIG. 3A after that engine coolant flows through a variable-sized annular channel 39 defined between an exterior surface of temperature-responsive warm-up valve 52 and an opposing interior surface of orifice insert 51.

Figure 11:
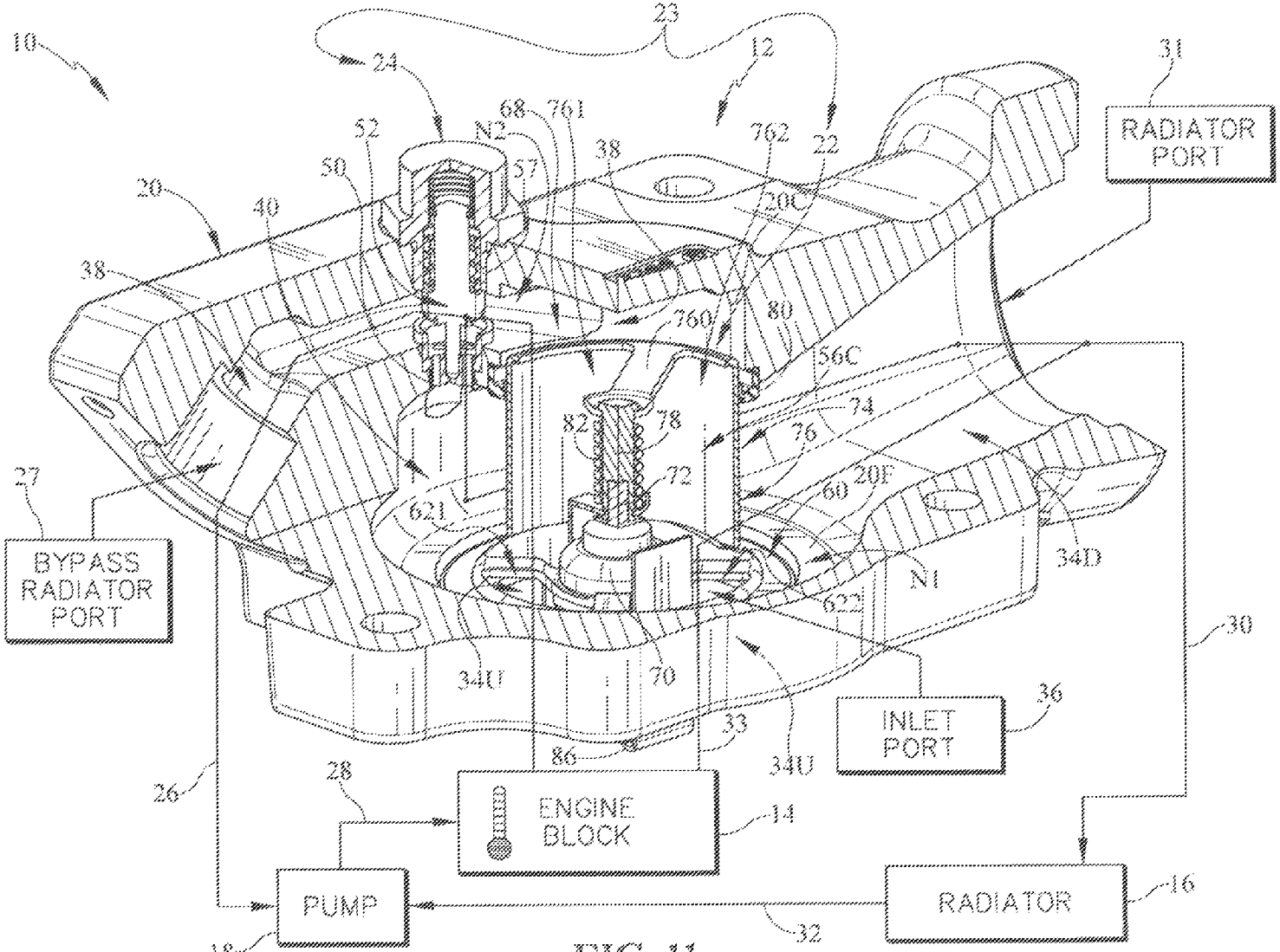
FIG. 11 is a view similar to FIG. 10 with further portions broken way showing the temperature-responsive radiator bypass valve of the radiator bypass thermostat in BYPASS position to cause all of the engine coolant to flow through the radiator bypass passageway and exit the fluid-control housing through the radiator bypass port.

Orifice inlet 51 is made of plastics or metal material and is sized to fit in a sealed position in orifice 50 formed in fluid-control housing 20 as suggested in FIGS. 3A and 11. Orifice inlet 51 is formed to include one or more coolant-flow passageways 51P to allow flow of engine coolant therethrough under control of temperature-responsive warm-up valve 52 as the engine coolant flows from variable-sized annular channel 39 between warm-up valve 52 and orifice insert 51 into radiator warm-up passageway 40.

Temperature-responsive warm-up valve 52 includes a piston 58 having a free end rigidly coupled to a central portion of orifice insert 51 and a proximal end fluidly coupled to thermal (e.g., wax) motor 59 as suggested in FIGS. 1B, 2, and 3. Thermal motor 59 comprises a coolant temperature sensor as suggested diagrammatically in FIG. 4 that is configured and arranged to detect the temperature of engine coolant flowing in radiator bypass passageway 38 while engine coolant is circulating in bypass loop 26L. Thermal motor 59 controls coolant flow through the variable-sized annular channel 39 provided between warm-up valve 52 and orifice insert 51 by thermally actuating move up and down along a vertical axis to vary the size of the annular channel 39 as a function of the detected temperature of engine coolant flowing past thermal motor 59 in radiator bypass passageway 38 suggested illustratively in FIGS. 3A-3D and diagrammatically in FIGS. 4-9.

Movable spring perch 54 is arranged to surround and move relative to the temperature-responsive radiator warm-up valve 52 as suggested in FIG. 1B. Movable spring perch 54 is engaged by an outer end of over-travel spring 53 and an inner end of valve-mover spring 55.

Over-travel spring 53 is arranged to surround radiator warm-up valve 52 and lie between and engage an underside of movable spring perch 54 and an annular spring seat 59S provided in thermal motor 59 of radiator warm-up valve 52 as suggested in FIG. 1B. Over-travel spring 53, movable spring perch 54, and valve-mover spring 55 cooperate to provide return means for yieldably urging the thermal motor 59 of the temperature-responsive radiator warm-up valve 52 to move downwardly away from the overlying stationary housing-mount cap 56 that is coupled to fluid-control housing 20 to assume a seated position in the orifice insert 51 when the thermal motor 59 senses that (1) the engine coolant is cold in early stages of an engine-start cycle or (2) engine coolant has ceased to circulate in bypass loop 26L.

Figure 3C:
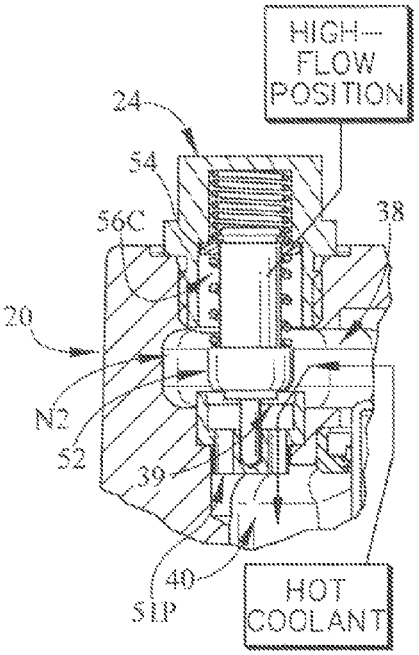
FIG. 3C is a view similar to FIGS. 3A and 3B showing movement of the temperature-responsive warm-up valve to a high-flow position when relatively hot coolant is passed through the radiator-bypass passageway so that an even larger stream of relatively hot engine coolant is diverted from the radiator bypass passageway to the radiator via the radiator warm-up passage.

Movable spring perch 54 is an annular washer made of metal in illustrative embodiments. Spring perch 54 is interposed between neighboring ends of valve-mover spring 55 and over-travel spring 53 as suggested in FIG. 1B. Spring perch 54 is arranged to slide up and down in a downwardly opening cavity 56C formed in housing-mount cap 56 during up-and-down movement of thermal motor 59 relative to the stationary piston 58 that is anchored to the orifice inlet 51. When thermal motor 59 reaches its full stroke as shown in FIG. 3C, the spring perch 54 engages an annular seat 56S formed in housing-mount cap 56 and arranged to define an upper boundary of the downwardly opening cavity 56C to cause the upper end of the over-travel spring 53, in effect, to engage and act against the stationary housing-mount cap 56. As suggested in FIG. 3D, at this stage, over-travel spring 53 is now active to provide means for preventing the thermal motor 59 from over-stroking at temperatures above the full open temperature of temperature-responsive radiator warm-up valve 52.

Housing-mount cap 56 is made of a plastics or metal material and is mounted in a stationary position on fluid-control housing 20 in a thermostat-receiver aperture 57 formed in fluid-control housing 20 as suggested in FIGS. 2, 10, and 11. Cap 56 retains all other components 52, 53, 54, 55 within housing 20 and interfaces with movable spring perch 54 to engage over-travel spring 53.

Figure 3D:
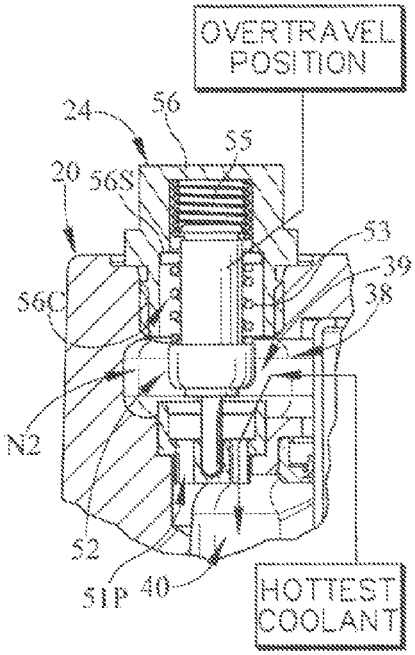
FIG. 3D is a view similar to FIGS. 3A-3C showing movement of the warm-up valve to an over-travel position when the hottest coolant is passed through the radiator bypass passageway.

Operation of radiator warm-up thermostat 24 to meter flow of warming engine coolant diverted from radiator bypass passageway 38 to radiator warm-up passageway 40 for delivery to radiator 16 via the downstream section 34D of fluid-transfer passageway 34 and radiator supply 30 as engine coolant circulates in bypass loop 26L is shown, for example, in FIGS. 3A-3D. In the BLEED position of the temperature-responsive warm-up valve 52 shown in FIG. 3A, the flow of engine coolant from radiator bypass passageway 38 to radiator 16 is metered by the clearance provided in the annular channel 39 defined between thermal motor 59 and orifice insert 51. In a partly opened LOW (flow) position of temperature-responsive warm-up valve 52 shown in FIG. 3B, thermal motor 59 begins to move upwardly relative to stationary piston 58 against the return means 53, 54, 55 as it is exposed to warming engine coolant in radiator bypass passageway 38. The size of the flow path provided by annular channel 39 defined between thermal motor 59 and orifice insert 51 increases to allow more warming engine coolant to flow through radiator warm-up passageway 40 to radiator 16. In an opened HIGH (flow) position of temperature-responsive warm-up valve 52 shown in FIG. 3C, the increased flow of engine coolant into the downstream radiator warm-up passageway 40 for delivery to radiator 16 is now metered by the coolant-flow passageways 51P formed in orifice insert 51. Once spring perch 54 is moved upwardly to engage the seat 56S provided in housing-mount cap 56 as shown in FIG. 3D, the thermal motor 59 can continue to move upwardly to compress over-travel spring 53 so that thermal motor 59 is protected from excessive internal pressures at high temperatures.

As suggested in FIG. 2, radiator bypass thermostat 22 includes a foundation 60 configured to be mounted in stationary position (see also FIG. 10) in a thermostat-receiver aperture 61 formed in fluid-control housing 20. Foundation 60 includes a base 62, a ring 64, and a gasket 66. Radiator bypass thermostat 22 also includes a temperature-responsive radiator bypass valve 68 comprising a thermal motor 70, a piston 72 associated with thermal motor 70, a coolant flow-blocker 74 comprising a cup 76, a pin 78, and a gasket 80 as shown in FIG. 2.

Radiator bypass thermostat 22 also includes a return spring 82, an over-travel spring 84, and a spring mount 86 for over-travel spring 84. Cup 76 includes a top wall 760 formed to include three coolant-flow apertures 761-763 and an annular side wall 764 coupled to a circular perimeter edge of top wall 760. Cup 76 is formed to include an interior chamber 76C bounded by top wall 760 and side wall 764 as suggested in FIGS. 2 and 12. Base 62 of foundation 60 is formed to include four coolant-flow apertures 621-624 arranged to receive engine coolant discharged from thermostat supply conduit 33 during flow of engine coolant either through radiator bypass loop 26L or radiator supply loop 30L.

Temperature-responsive bypass valve 68 of radiator bypass thermostat 22 includes a coolant-flow blocker 74, a piston 72 having a free end rigidly coupled to pin 78 of coolant-flow blocker 74 and a proximal end fluidly coupled to thermal (e.g., wax) motor 70 as suggested in FIGS. 2, 3, and 11. Thermal motor 70 comprises a coolant temperature sensor as suggested diagrammatically in FIG. 4 that is configured and arranged to detect the temperature of engine coolant discharged into downstream section 34D of fluid-transfer passageway 34 from inlet port 36 while engine coolant is flowing in either bypass loop 26L or radiator loop 30L. Thermal motor 70 controls coolant flow from the thermostat supply conduit 33 and engine 14 into either bypass loop 26L or radiator loop 30L by thermally actuating to move up and down along a vertical axis to move cup 76 of coolant flow blocker 74 up-and-down relative to fluid-control housing 20 and the passageways 34U, 34D, and 38 formed therein as suggested diagrammatically in FIGS. 4-9 and illustratively in FIGS. 11-13.

When engine coolant is relatively cold as suggested diagrammatically in FIG. 4, radiator bypass thermostat 22 is moved in fluid-control housing 20 to the BYPASS mode to cause engine coolant entering fluid-control housing 20 to circulate in bypass loop 26L without flowing through radiator 16. In an illustrative embodiment shown in FIG. 11, cup 76 is moved by thermal motor 70 to a lowest position to block flow of engine coolant from upstream section 34U of fluid-transfer channel 34 to downstream section 34D of fluid-transfer channel 34 but allow flow of engine coolant from upstream section 34U of fluid-transfer passageway 34 into radiator bypass passageway 38 via interior chamber 76C of cup 76 and coolant-flow apertures 761-763 formed in top wall 760 of cup 76.

When engine coolant begins to warm up later in an engine-start cycle as suggested diagrammatically in FIG. 7, radiator bypass thermostat 22 is moved in fluid-control housing 20 to the SPLIT mode to cause some of the engine coolant entering fluid-control housing 20 to circulate in bypass loop 26L and the rest of that engine coolant to circulate in radiator loop 30L. In an illustrative embodiment shown in FIG. 12, cup 76 is moved by thermal motor 70 to a midway position to open an engine-coolant flow passage under a bottom edge of cup 76 between upstream and downstream sections 34U, 34D of fluid-transfer passageway to allow coolant flow in radiator loop 30L while still allowing upward flow of engine coolant into radiator bypass passageway through interior chamber 76C of cup and coolant-flow apertures 761-763 formed in top wall 760 of cup 76.

Figure 9:
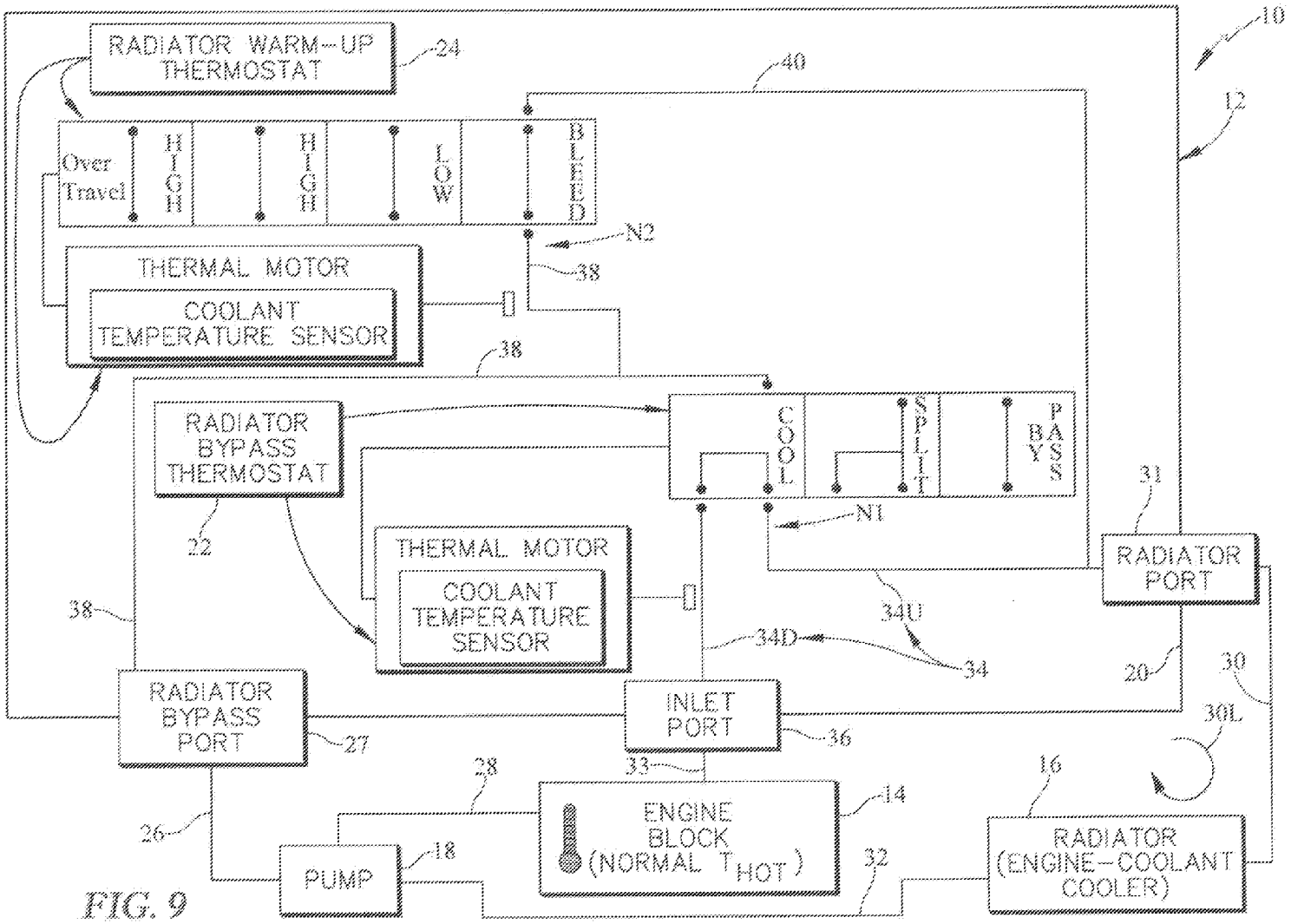

When engine coolant is heated to a hot temperature as suggested diagrammatically in FIG. 9, radiator bypass thermostat 22 is moved in fluid-control housing 20 to a COOL mode to cause all of the engine coolant to flow from upstream section 34U of fluid-transfer passageway 34 into downstream section 34D of fluid-transfer passageway 34 and to block flow of engine coolant into radiator bypass passageway 38 so that all engine coolant circulates in radiator loop 30L. In an illustrative embodiment shown in FIG. 13, cup 76 is moved upwardly by thermal motor 70 to a highest position to engage an overlying ceiling 20C formed in fluid-control housing 20 to block flow of any engine coolant from interior chamber 76C of cup 76 into radiator bypass passageway 38 through coolant-flow apertures 761-763 formed in top wall 760 of cup 76.

Diagrammatic views of a vehicle engine system 10 in accordance with the present disclosure are provided in FIGS. 4-9 to illustrate operation of radiator warm-up thermostat 24 to warm radiator 16 during early stages of an engine-start cycle before radiator bypass thermostat 22 is changed from a radiator bypass mode to a radiator supply mode to cause all engine coolant flowing through engine 14 to flow through radiator 16.

A COLD-START phase of an engine start-up cycle for a vehicle engine system in accordance with the present disclosure is illustrated diagrammatically in FIG. 4 in which a temperature-responsive bypass valve 74 in radiator bypass thermostat 22 is in a BYPASS position and a temperature-responsive warm-up valve 52 in radiator warm-up thermostat 24 is in a BLEED position. In this phase, most of the engine coolant is circulating in bypass loop 26L and starting to warm up as it flows through the engine 14. When temperature-responsive warm-up valve 52 is in the BLEED position, radiator warm-up thermostat 24 diverts a small amount of warming engine coolant from radiator bypass passageway 38 through annular channel 59 between thermal motor 59 and orifice insert 51 and then through coolant-flow passageways 51P formed in orifice insert 51 into radiator warm-up passageway 40 to reach radiator 16 via downstream section 34D of fluid-transfer passageway 34 and radiator supply 30.

Figure 5:
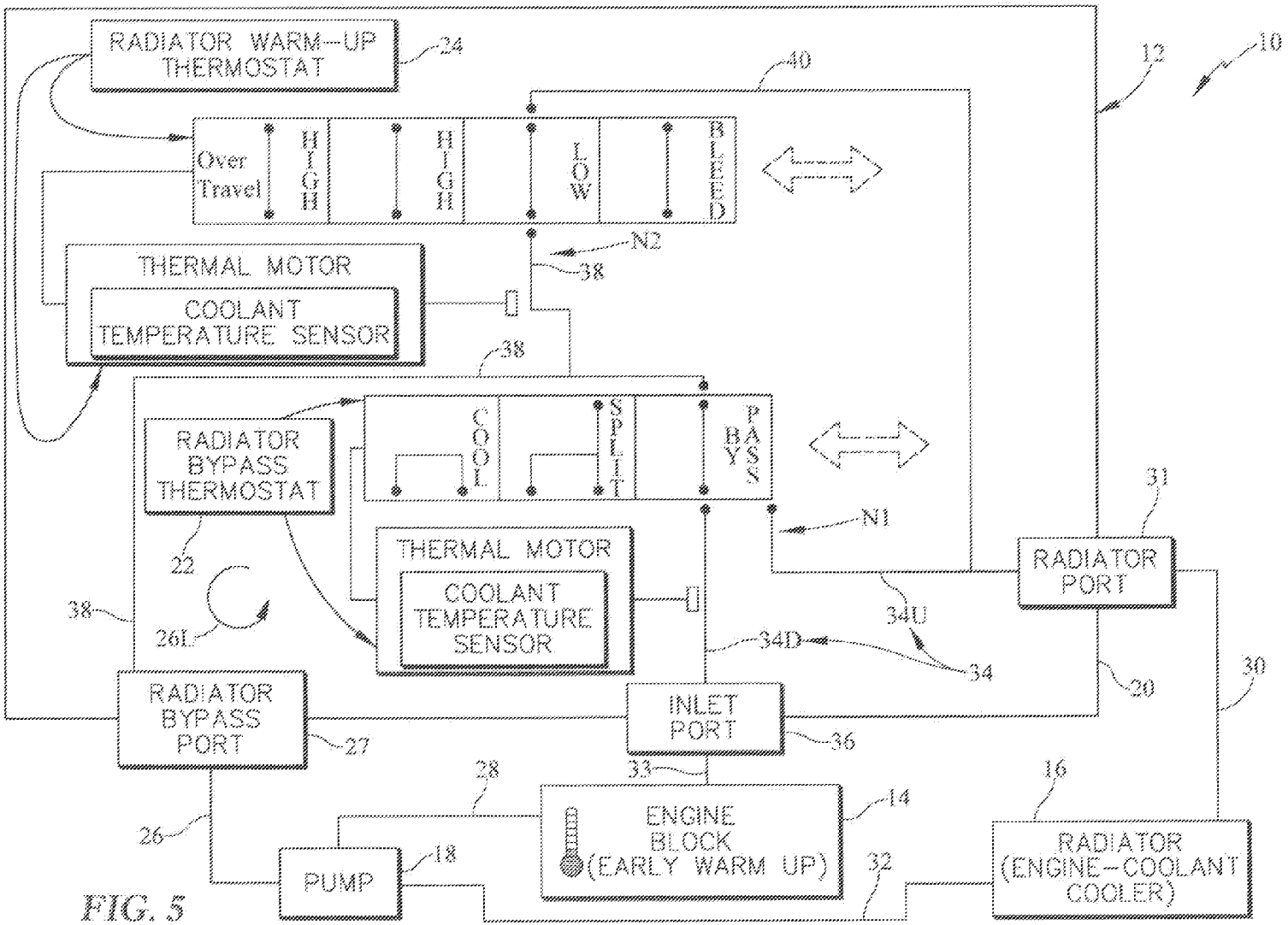

An EARLY WARM-UP phase of an engine-start cycle for a vehicle engine system in accordance with the present disclosure is illustrated diagrammatically in FIG. 5 in which temperature-responsive bypass valve 74 of radiator bypass thermostat 22 remains in the BYPASS position while temperature-responsive warm-up valve 52 of radiator warm-up thermostat 24 is now in the LOW (flow) position. In this phase, the engine coolant has warmed a bit and that temperature increase is enough to cause thermal motor 59 to move relative to orifice insert 51 to open annular channel 39 more to a low (flow) position.

Figure 6:
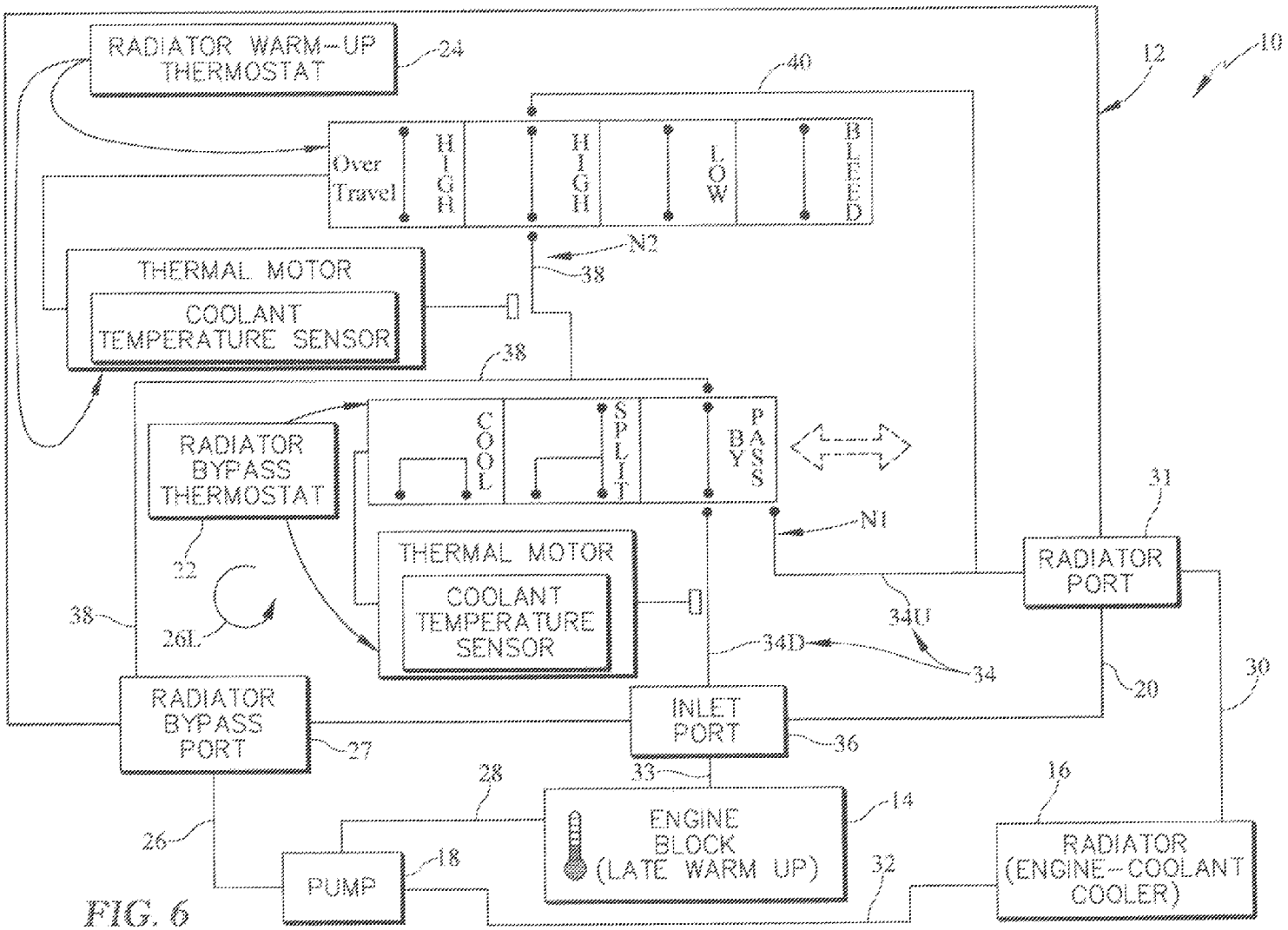

A LATE WARM-UP phase of an engine-start cycle for a vehicle engine system in accordance with the present disclosure is illustrated diagrammatically in FIG. 6 in which temperature-responsive bypass valve 74 of radiator bypass thermostat 22 remains in the BYPASS position while temperature-responsive warm-up valve 52 of radiator warm-up thermostat 24 is now in the HIGH (flow) position. In this later phase, the engine coolant has warmed even more to cause thermal motor 59 to move further relative to orifice insert to open annular channel 39 to a HIGH (flow) position.

Figure 7:
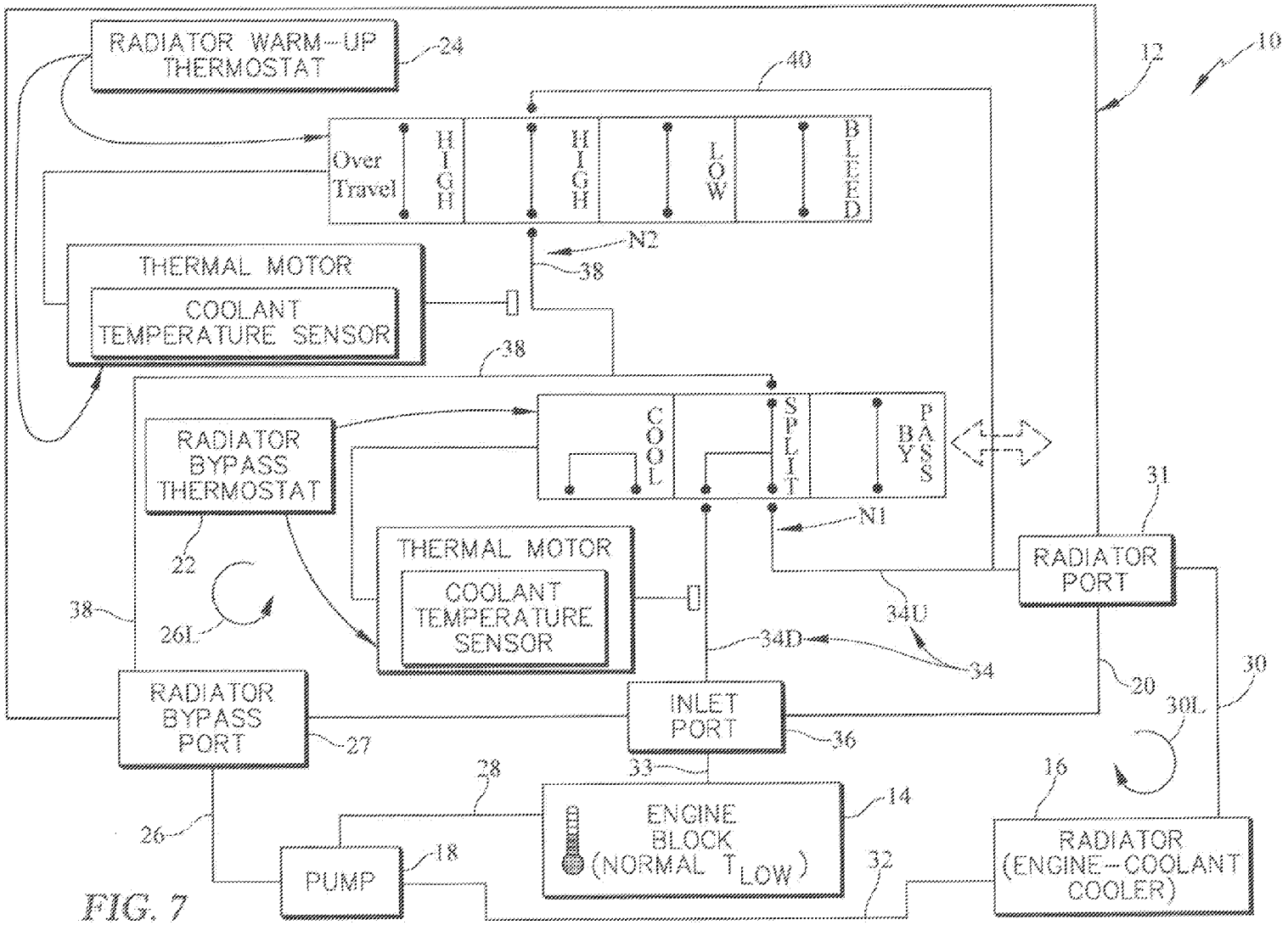

A first NORMAL (low-temperature) phase of an engine-operation cycle for a vehicle engine system in accordance with the present disclosure is illustrated diagrammatically in FIG. 7 in which temperature-responsive bypass valve 74 is now in a SPLIT position to allow engine coolant to flow through each of the radiator bypass and the radiator supply zones 26, 30. Temperature-responsive warm-up valve 52 of radiator warm-up thermostat 24 remains in the HIGH (flow) position.

Figure 8:
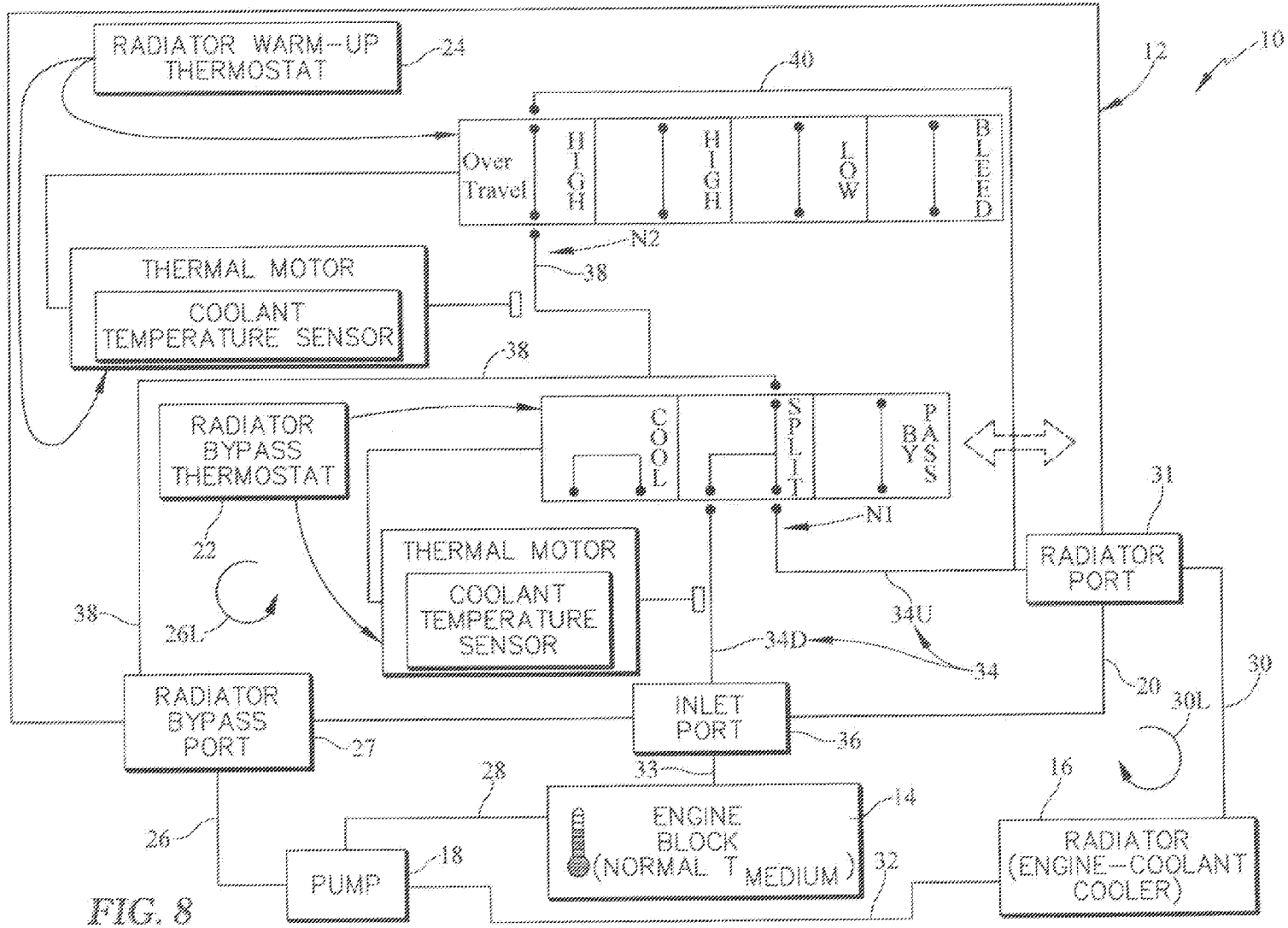

A second NORMAL (medium-temperature) phase of an engine-operation cycle for a vehicle engine system in accordance with the present disclosure is illustrated diagrammatically in FIG. 8 in which temperature-responsive bypass valve 74 of radiator bypass thermostat 22 remains in a SPLIT position. Temperature-responsive warm-up valve 52 of radiator warm-up thermostat 24 is now in an OVER-TRAVEL position.

A third NORMAL (hot-temperature) phase of an engine-operation cycle for a vehicle engine system in accordance with the present disclosure is illustrated diagrammatically in FIG. 9 in which temperature-responsive bypass valve 74 in radiator bypass thermostat 22 is now in a COOL position to cause all engine coolant exiting engine 14 to flow through radiator 16 before it is returned to engine 14. Temperature-responsive warm-up valve 52 of radiator warm-up thermostat 24 has been returned to the BLEED position so that it is ready for the next engine start-up cycle.

Fluid regulator 12 includes a fluid-control housing 20 and a fluid-flow controller 23 in fluid-control housing 20 as suggested in FIG. 1. Fluid-control housing 20 is formed to include a fluid-transfer passageway 34 through which engine coolant can flow to reach a radiator 16 and a radiator-bypass passageway 38 through which engine coolant can flow to pass through a vehicle engine 14 without passing through the radiator 16.

Fluid-flow controller 23 is configured to circulate most of the engine coolant through a bypass loop 26L when the engine coolant is relatively cold but warming in the early stages of an engine start-up cycle as suggested in FIGS. 1 and 4-6. Some of the engine coolant circulating in bypass loop 26L is diverted from that bypass loop 26L and caused to flow through a radiator warm-up passageway 40 into a radiator supply loop 30L and through radiator 16 so as to warm up radiator 16 and any reserve engine coolant stored in radiator 16 before bypass loop 26L is closed and all of the engine coolant is caused to flow in radiator loop 30L.

In illustrative embodiments, fluid-flow controller 23 includes a radiator bypass thermostat 22 configured to sense the temperature of engine coolant discharged from an engine 14 and to divert coolant into a bypass loop 26L during engine start-up and then, when the engine coolant is hot, into a radiator loop 30L so that the hot engine coolant is cooled as it passes through the radiator 16 as suggested in FIGS. 1 and 7-9. The radiator bypass thermostat 22 is located in a fluid-transfer passageway 34 provided in a fluid-control housing 20 of a fluid regulator included in an engine coolant system 10. The radiator bypass thermostat 22 includes a temperature-responsive bypass valve 68 that is arranged to move in the fluid-transfer passageway 34 between a radiator-bypass position and a radiator-supply position. At engine start-up, the engine 14 is cold and the bypass valve 68 is exposed to cold engine coolant present in the fluid-transfer passageway 34 and is urged by a valve-mover spring 82 to the radiator-bypass position to divert flow of cold engine coolant into the radiator-bypass passageway 38 for return to the vehicle engine 14. Thus, the engine coolant is circulated in the bypass loop 26L and through the engine 14 so that it can warm up and is not passed through the radiator 16 while it is cold. When exposed to hot engine coolant flowing in the fluid-transfer passageway 34, the temperature-responsive bypass valve 68 is configured to move automatically against the valve-mover spring 82 to the radiator-supply position in the fluid-transfer passageway 34 to close the radiator-bypass passageway 38 and open a radiator loop 30L to cause the hot engine coolant to flow through the radiator 16 where it is cooled before the engine coolant is returned to the engine 14.

In illustrative embodiments, fluid-flow controller 23 also includes a radiator warm-up thermostat 24 located in the radiator-bypass passageway 38 and configured to divert some of the engine coolant circulating in the bypass loop 26L at engine start-up into the radiator 16 to warm up the radiator 16. The fluid-control housing 20 is also formed to include a radiator warm-up passageway 40 having an outlet communicating with the fluid-transfer passageway 34 at a point downstream from the radiator bypass thermostat 22 and upstream from the radiator 16. The radiator warm-up thermostat 34 includes a temperature-responsive warm-up valve 52 that is arranged to move in the radiator-bypass passageway 38 to divert a small BLEED amount initially (and increasingly larger amounts later) of warming engine coolant from the radiator-bypass passageway 38 in the bypass loop 26L so it can flow through the radiator warm-up passageway 40 past the radiator bypass thermostat 22 into a downstream section 34D of the fluid-transfer passageway 34 in the radiator loop 30L to reach and flow through and begin to warm up the radiator 16 before the temperature-responsive bypass valve 52 in the radiator bypass thermostat 24 is moved to the radiator-supply position once the engine coolant has been heated by the vehicle engine 14 to the predetermined hot temperature.

A fluid regulator 12 is provided for use in an engine coolant system 10 including an engine 14 and a radiator 16 as suggested in FIG. 1. Fluid regulator includes a fluid-control housing 20 and a fluid-flow controller 23 as suggested diagrammatically in FIG. 1 and illustratively in FIGS. 10-13.

Fluid-control housing 20 is formed to include an inlet port 36 arranged to receive engine coolant from engine 14, a radiator port 31 arranged to discharge engine coolant to radiator 16 associated with engine 14, and a radiator bypass port 27 arranged to discharge engine coolant to engine 14 as suggested in FIGS. 1, 4, and 11. Fluid-control housing 20 is also formed to include a fluid-transfer passageway 34 arranged to conduct engine coolant flowing in a radiator loop 30L through the engine 14 and the radiator 16 in the fluid-control housing 20 from the inlet port 36 to the radiator port 31 and a radiator-bypass passageway 38 arranged to conduct engine coolant flowing in a bypass loop 26L through the engine 14 without passing through the radiator 16 from a first thermostat node N1 located in the fluid-transfer passageway 34 to the radiator bypass port 27. First thermostat node N1 is located in the fluid-control housing 20 to divide the fluid-transfer passageway 34 into an upstream section 34U arranged to interconnect the inlet port 36 and the first thermostat node N1 in fluid communication and a downstream section 34D arranged to interconnect the first thermostat node N1 and the radiator port 31 in fluid communication.

Fluid-flow controller 23 is located in fluid-control housing 20 as suggested in FIG. 1. Fluid-flow controller 23 includes a radiator bypass thermostat 22 located at the first thermostat node N1 and configured to divert flow of engine coolant flowing in the upstream section 34U of the fluid-transfer passageway 34 into the radiator bypass passageway 38 for circulation in the bypass loop 26L when the temperature of the engine coolant at the first thermostat node N1 is below a predetermined temperature and into the downstream section 34D of the fluid-transfer passageway 34 for circulation in the radiator loop 30L when the temperature of the engine coolant at the first thermostat node N1 is at least the predetermined temperature. Fluid-flow controller 23 also includes a radiator warm-up thermostat 34 located at a second thermostat node N2 provided in the radiator bypass passageway 38 to communicate with engine coolant flowing in the radiator bypass passageway 38.

Fluid-control housing 20 further includes a radiator warm-up passageway 40 arranged to conduct engine coolant from the second thermostat node N2 to the downstream section 34D of the fluid-transfer passageway 34 for delivery to the radiator port 31 as suggested in FIG. 1. Radiator warm-up thermostat 24 is configured to provide means for diverting a stream of warming engine coolant from the engine coolant circulating in the bypass loop 26L and flowing in the radiator bypass passageway 38 from the first thermostat node N1 to the radiator bypass port 27 into the radiator warm-up passageway 40 during an early stage of an engine start-up cycle when the engine coolant is circulating mainly in the bypass loop 26L to cause the stream of warming engine coolant to flow through the radiator warm-up passageway 40 into the downstream section 34D of the fluid-transfer passageway 34 to exit the fluid-control housing 20 through the radiator port 31 so that the stream of warming engine coolant exiting through the radiator port 31 can flow through the radiator 16 and the radiator loop 30L to pre-warm the radiator 16 and any reserve engine coolant in the radiator 16 before the temperature of engine coolant at the first thermostat node N1 reaches the predetermined temperature to cause the radiator bypass thermostat 22 to block further flow of engine coolant into the radiator bypass passageway 38 and direct such flow of engine coolant into the downstream section 34D of the fluid-transfer passageway 34 for circulation in the radiator loop 30L through the radiator 16.

Figure 12:
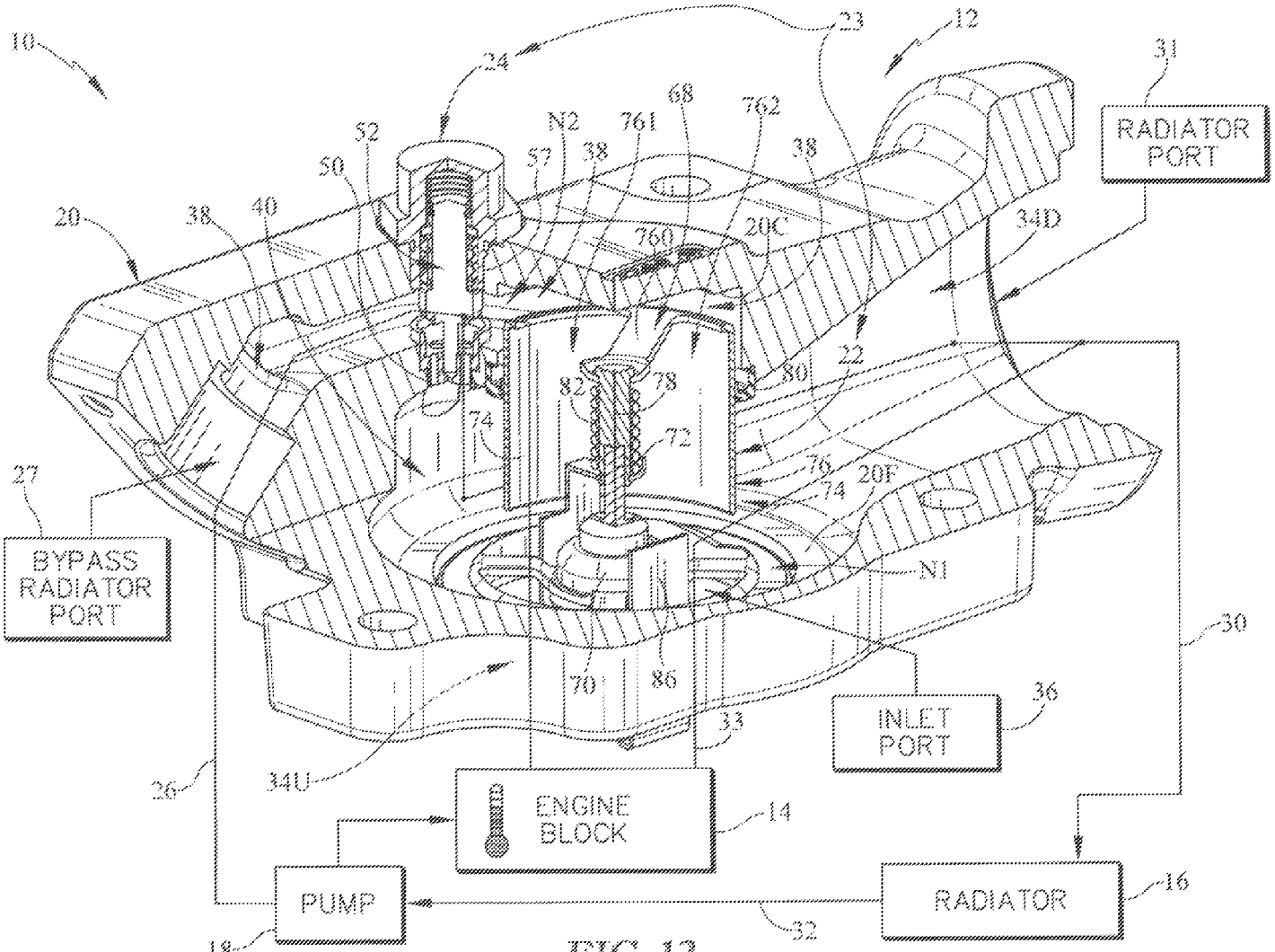
FIG. 12 is a view similar to FIG. 11 showing the temperature-responsive bypass valve of the radiator bypass thermostat in the SPLIT position so that some engine coolant flows through the radiator bypass passageway and some of the engine coolant flows to the radiator via the fluid-transfer passageway and the radiator port.
Figure 13:
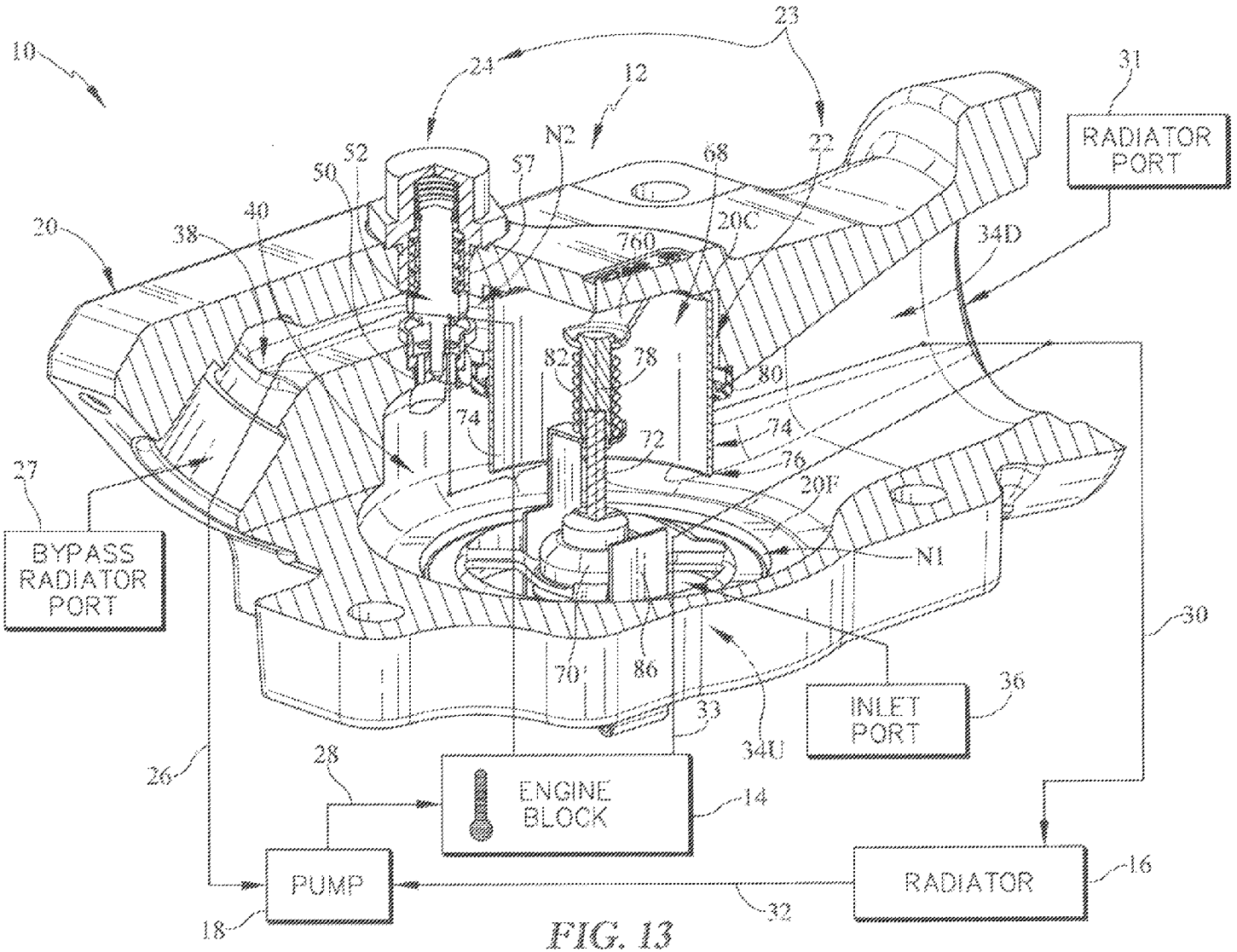
FIG. 13 is a view similar to FIGS. 11 and 12 showing the temperature-responsive bypass valve of the radiator bypass thermostat in the COOL position to block flow of engine coolant through the radiator bypass passageway and direct flow of all engine coolant through the fluid-transfer passageway to the radiator.

Radiator bypass thermostat 22 includes a temperature-responsive bypass valve 68 mounted for up-and-down movement along a central axis in the fluid-transfer passageway 34 at the first thermostat node N1 between a radiator-bypass position shown, for example, in FIG. 11 in which the temperature-responsive bypass valve 68 engages foundation 60 coupled to a floor 20F included in the fluid-control housing 20 to block flow of engine coolant from the upstream section 34U of fluid-transfer passageway 34 into downstream section 34D of fluid-transfer passageway 34 and a radiator-supply position in which engine coolant is free to flow from the upstream section 34U of the fluid-transfer passageway 34 into the radiator-bypass passageway 38 through an interior passageway 761 formed in the temperature-responsive bypass valve and a radiator-supply position shown, for example, in FIGS. 12 and 13 in which temperature-responsive bypass valve 68 is separated from foundation 60 to allow flow of engine coolant into downstream section 34D of fluid-transfer passageway 34.

Temperature-responsive bypass valve 68 includes a thermal motor 70 mounted in a stationary position in the fluid-control housing 20 to intercept engine coolant flowing through the fluid-transfer passageway 34, a coolant-flow blocker 77, and a piston 72 as suggested in FIGS. 2 and 11.

Coolant-flow blocker 77 is arranged to move between the floor 20F and ceiling of the fluid-control housing 20 as suggested in FIGS. 11-13. Coolant-flow blocker 77 is formed to include a side wall 764 arranged to surround the central axis and a top wall 760 coupled to the side wall 764 to define an interior chamber 76C in communication with engine coolant in the upstream section 34U of the fluid-transfer channel 34 and at least one coolant-flow aperture 761-763 communicating with the interior chamber 76C and the radiator bypass passageway 38 to define the interior passageway 761 of the temperature-responsive bypass valve 68. Side wall 764 and top wall 760 cooperate to form a cup 76 coupled to pin 78 as suggested in FIGS. 2 and 11. Piston 72 is arranged to engage the coolant-flow blocker 77 by means of a rigid coupling between pin 78 and piston 72 as shown in FIG. 11. Piston 72 is mounted for up-and-down movement along the central axis relative to the thermal motor 70 to lower the coolant-flow blocker 77 to a radiator-bypass position mating with the foundation 60 associated with floor 20F of the fluid-control housing 20 as suggested in FIG. 11 to cause flow of engine coolant from the upstream section 34U of the fluid-transfer passageway 34 to flow into the radiator bypass passageway 38 via the interior chamber 76C and coolant-flow apertures 761-763 formed in the coolant-flow blocker 77 without flowing directly from the upstream section 34U of the fluid-transfer passageway 34 to the downstream section 34D of the fluid-transfer passageway 34 at the first thermostat node N1 and to raise the coolant-flow blocker 77 away from the foundation 60 associated with floor 20F to a radiator-supply position mating with a ceiling 20C included in the fluid-control housing 20 above and in spaced-apart relation to the foundation 60 associated with the floor 20F as suggested in FIG. 13 to block flow of engine coolant from the interior chamber 76C into the radiator bypass passageway 38 through the coolant-flow apertures 761-763 and to all flow of engine coolant directly from the upstream section 34U of the fluid-transfer passageway 34 into the downstream section 34D of the fluid-transfer passageway 34.

Fluid-control housing 20 is formed to include an orifice 50 coupling the radiator-bypass passageway 38 and the radiator warm-up passageway 40 as suggested in FIG. 11. Radiator warm-up thermostat 24 includes a temperature-responsive warm-up valve 52 mounted for movement in the orifice 50 to vary the flow of engine coolant from the radiator bypass passageway 38 into the radiator warm-up passageway 40 as temperature of engine coolant flowing through the orifice 50 varies.

Radiator warm-up thermostat 24 further includes an orifice inlet 51 mounted in a sealed position in the orifice 50 and formed to include a coolant-conductor passageway 51C, 51P extending therethrough in fluid communication with each of the radiator bypass passageway 38 and radiator warm-up passageway 40 as suggested in FIGS. 1B and 11. Temperature-responsive warm-up valve 52 is arranged to move in the coolant-conductor passageway 51C, 51P to define therebetween a variable-size annular channel 39 through which the engine coolant flows from the radiator bypass passageway 38 to the radiator warm-up passageway 40.

Orifice inlet 51 includes an upper collar 51U and a lower collar 51L as shown, for example, in FIGS. 1A and 1B. Upper collar 51U is formed to include a collar cavity 51C receiving the temperature-responsive warm-up valve 52 therein to define the variable-size annular channel 39 between an exterior surface of the temperature-responsive warm-up valve 52 and an interior surface of the upper collar 51U. Lower collar 51L is coupled to the upper collar 51U and formed to include at least one coolant-flow passageway 51P arranged to interconnect the collar cavity 51C and the radiator warm-up passageway 38 in fluid communication and provide means for metering flow of engine coolant from the radiator bypass passageway 38 into the radiator warm-up passageway 40 once the size of the annular channel 39 becomes greater than a predetermined size as temperature of engine coolant flowing through the collar cavity 51C increases above a predetermined temperature.

Temperature-responsive warm-up valve 52 of radiator warm-up thermostat 24 includes a thermal motor 59 and a piston 58 having a free end rigidly coupled to a central portion of the orifice insert 51 and fluidly coupled to the thermal motor 70 as shown, for example, in FIG. 1B. Thermal motor 59 is arranged to extend into the coolant-conductor passageway 51C, 51P formed in the orifice inlet 51 to define the variable-size annular channel 39 therebetween and to move relative to the piston 58 in response to changing temperature of engine coolant flowing in the coolant-conductor passageway 51C, 51P to vary the size of the variable-size annular channel 39.

Radiator warm-up thermostat 24 further includes a housing-mount cap 56 coupled to the fluid-control housing 20, a movable spring perch 54 located between the housing-mount cap 56 and a spring seat 59S included in the thermal motor 59, a valve-mover spring 50 arranged to act against the housing-mount cap 56 and a topside of the movable spring perch 54, and an over-travel spring 53. Over-travel spring 53 is arranged to act against an underside of the movable spring perch 54 and the spring seat 59S of the thermal motor 59 normally to cooperate with the valve-mover spring 55 and the spring perch 54 to provide return means for yieldably urging the thermal motor 59 to move toward the orifice inlet 51 normally to establish a bleed position of the thermal motor 59 in which the stream of engine coolant passing from the radiator bypass passageway 38 to the radiator warm-up passageway 40 is small.

Housing-mount cap 56 is formed to include an annular seat 56S arranged to face downwardly toward the topside of the spring perch 54 Annular seat 56S is arranged to engage the movable spring perch 54 in response to upward movement of the thermal motor 59 away from the orifice inlet 51 to allow further upward movement of the thermal motor 59 to compress the over-travel spring 53 between the now-stationary spring perch 54 and the spring seat 59S on the thermal motor 59.

The invention claimed is:

1. A fluid regulator for use in an engine coolant system including an engine and a radiator, the fluid regulator comprising a fluid-control housing formed to include an inlet port arranged to receive engine coolant from an engine, a radiator port arranged to discharge engine coolant to a radiator associated with the engine, and a radiator bypass port arranged to discharge engine coolant to the engine, the fluid-control housing also being formed to include a fluid-transfer passageway arranged to conduct engine coolant flowing in a radiator loop through the engine and the radiator in the fluid-control housing from the inlet port to the radiator port and a radiator-bypass passageway arranged to conduct engine coolant flowing in a bypass loop through the engine without passing through the radiator from a first thermostat node located in the fluid-transfer passageway to the radiator bypass port, the first thermostat node being located in the fluid-control housing to divide the fluid-transfer passageway into an upstream section arranged to interconnect the inlet port and the first thermostat node in fluid communication and a downstream section arranged to interconnect the first thermostat node and the radiator port in fluid communication, a fluid-flow controller located in the fluid-control housing, the fluid-flow controller including a radiator bypass thermostat located at the first thermostat node and configured to divert flow of engine coolant flowing in the upstream section of the fluid-transfer passageway into the radiator bypass passageway for circulation in the bypass loop when the temperature of the engine coolant at the first thermostat node is below a predetermined temperature and into the downstream section of the fluid-transfer passageway for circulation in the radiator loop when the temperature of the engine coolant at the first thermostat node is at least the predetermined temperature, the fluid-flow controller also including a radiator warm-up thermostat located at a second thermostat node provided in the radiator bypass passageway to communicate with engine coolant flowing in the radiator bypass passageway, wherein the fluid-control housing further includes a radiator warm-up passageway arranged to conduct engine coolant from the second thermostat node to the downstream section of the fluid-transfer passageway for delivery to the radiator port, and wherein the radiator warm-up thermostat is configured to divert a stream of warming engine coolant from the engine coolant circulating in the bypass loop and flowing in the radiator bypass passageway from the first thermostat node to the radiator bypass port into the radiator warm-up passageway during an early stage of an engine start-up cycle when the engine coolant is circulating mainly in the bypass loop to cause the stream of warming engine coolant to flow through the radiator warm-up passageway into the downstream section of the fluid-transfer passageway to exit the fluid-control housing through the radiator port so that the stream of warming engine coolant exiting through the radiator port can flow through the radiator and the radiator loop to pre-warm the radiator and any reserve engine coolant in the radiator before the temperature of engine coolant at the first thermostat node reaches the predetermined temperature to cause the radiator bypass thermostat to block further flow of engine coolant into the radiator bypass passageway and direct such flow of engine coolant into the downstream section of the fluid-transfer passageway for circulation in the radiator loop through the radiator.

2. The fluid regulator of claim 1, wherein the radiator bypass thermostat includes a temperature-responsive bypass valve mounted for up-and-down movement along a central axis in the fluid-transfer passageway at the first thermostat node between a radiator-bypass position in which the temperature-responsive bypass valve engages foundation included in the radiator bypass thermostat and coupled to a floor included in the fluid-control housing to block flow of engine coolant from the upstream section of the fluid-transfer passageway into the downstream section of the fluid-transfer passageway in which engine coolant is free to flow from the upstream section of the fluid-transfer passageway into the radiator-bypass passageway through an interior passageway formed in the temperature-responsive bypass valve and a radiator-supply position in which the temperature-responsive bypass valve is separated from the foundation to allow flow of engine coolant therebetween into the downstream section of the fluid-transfer passageway.

3. The fluid regulator of claim 2, wherein the temperature-responsive bypass valve includes a thermal motor mounted in a stationary position in the fluid-control housing to intercept engine coolant flowing through the fluid-transfer passageway, a coolant-flow blocker arranged to move between the foundation associated with the floor and ceiling of the fluid-control housing and formed to include a side wall arranged to surround the central axis and a top wall coupled to the side wall to define an interior chamber in communication with engine coolant in the upstream section of the fluid-transfer channel and at least one coolant-flow aperture communicating with the interior chamber and the radiator bypass passageway to define the interior passageway of the temperature-responsive bypass valve, and a piston arranged to engage the coolant-flow blocker and mounted for up-and-down movement along the central axis relative to the thermal motor to lower the coolant-flow blocker to a radiator-bypass position mating with the foundation associated with the floor of the fluid-control housing to cause flow of engine coolant from the upstream section of the fluid-transfer passageway to flow into the radiator bypass passageway via the interior chamber and coolant-flow aperture formed in the coolant-flow blocker without flowing directly from the upstream section of the fluid-transfer passageway to the downstream section of the fluid-transfer passageway at the first thermostat node and to raise the coolant-flow blocker away from the foundation associated with the floor to a radiator-supply position mating with a ceiling included in the fluid-control housing above and in spaced-apart relation to the foundation associated with the floor to block flow of engine coolant from the interior chamber into the radiator bypass passageway through the coolant-flow aperture and to all flow of engine coolant directly from the upstream section of the fluid-transfer passageway into the downstream section of the fluid-transfer passageway.

4. The fluid regulator of claim 1, wherein the fluid-control housing is formed to include an orifice coupling the radiator-bypass passageway and the radiator warm-up passageway and the radiator warm-up thermostat includes a temperature-responsive warm-up valve mounted for movement in the orifice to vary the flow of engine coolant from the radiator bypass passageway into the radiator warm-up passageway as temperature of engine coolant flowing through the orifice varies.

5. The fluid regulator of claim 4, wherein the radiator warm-up thermostat further includes an orifice insert mounted in a sealed position in the orifice and formed to include a coolant-conductor passageway extending therethrough in fluid communication with each of the radiator bypass passageway and radiator warm-up passageway and the temperature-responsive warm-up valve is arranged to move in the coolant-conductor passageway to define a variable-size annular channel through which the engine coolant flows from the radiator bypass passageway to the radiator warm-up passageway.

6. The fluid regulator of claim 5, wherein the orifice insert includes an upper collar formed to include a collar cavity receiving the temperature-responsive warm-up valve therein to define the variable-size annular channel between an exterior surface of the temperature-responsive warm-up valve and an interior surface of the upper collar and a lower collar coupled to the upper collar and formed to include at least one coolant-flow passageway arranged to interconnect the collar cavity and the radiator warm-up passageway in fluid communication and configured to meter flow of engine coolant from the radiator bypass passageway into the radiator warm-up passageway once the size of the annular channel becomes greater than a predetermined size as temperature of engine coolant flowing through the collar cavity increases above a predetermined temperature.

7. The fluid regulator of claim 5, wherein the temperature-responsive warm-up valve includes a thermal motor and a piston having a free end rigidly coupled to a central portion of the orifice insert and fluidly coupled to the thermal motor and the thermal motor is arranged to extend into the coolant-conductor passageway formed in the orifice insert to define the variable-size annular channel therebetween and to move relative to the piston in response to changing temperature of engine coolant flowing in the coolant-conductor passageway to vary the size of the variable-size annular channel.

8. The fluid regulator of claim 7, wherein the radiator warm-up thermostat further includes a housing-mount cap coupled to the fluid-control housing, a movable spring perch located between the housing-mount cap and a spring seat included in the thermal motor, a valve-mover spring arranged to act against the housing-mount cap and a topside of the movable spring perch, and an over-travel spring arranged to act against an underside of the movable spring perch and the spring seat of the thermal motor normally to cooperate with the valve-mover spring and the spring perch configured to urge the thermal motor to move toward the orifice insert normally to establish a bleed position of the thermal motor in which the stream of engine coolant passing from the radiator bypass passageway to the radiator warm-up passageway is small.

9. The fluid regulator of claim 8, wherein the housing-mount cap is formed to include an annular seat arranged to face downwardly toward the topside of the spring perch and to engage the movable spring perch in response to upward movement of the thermal motor away from the orifice insert to allow further upward movement of the thermal motor to compress the over-travel spring between the now-stationary spring perch and the spring seat on the thermal motor.

10. A fluid regulator for use in an engine coolant system including a radiator loop comprising an engine and a radiator and a bypass loop comprising the engine, the fluid regulator comprising a fluid-control housing, a radiator bypass thermostat located at a first thermostat node provided in the fluid-control housing, the radiator bypass thermostat configured to direct flow of engine coolant through the bypass loop until engine coolant at the first thermostat node rises to a predetermined temperature and flow of engine coolant is directed through the radiator loop, and a radiator warm-up thermostat located at a second thermostat node in a radiator bypass-passageway formed in the fluid-control housing and included in the bypass loop and configured to divert some of the engine coolant flowing in the radiator bypass passageway at the second thermostat node into a radiator warm-up passageway formed in the fluid-control housing and coupled in fluid communication to a portion of the radiator loop formed in the fluid-control housing to cause that diverted engine coolant to flow through the radiator loop and pre-warm the radiator while most of the engine coolant is circulating in the bypass loop.

11. The fluid regulator of claim 10, wherein the radiator bypass thermostat includes a temperature-responsive bypass valve mounted for up-and-down movement along a central axis in a fluid-transfer passageway at the first thermostat node between a radiator-bypass position in which the temperature-responsive bypass valve engages foundation included in the radiator bypass thermostat and coupled to a floor included in the fluid-control housing to block flow of engine coolant from the upstream section of the fluid-transfer passageway into the downstream section of the fluid-transfer passageway in which engine coolant is free to flow from the upstream section of the fluid-transfer passageway into the radiator-bypass passageway through an interior passageway formed in the temperature-responsive bypass valve and a radiator-supply position in which the temperature-responsive bypass valve is separated from the foundation to allow flow of engine coolant therebetween into a downstream section of the fluid-transfer passageway.

12. The fluid regulator of claim 11, wherein the temperature-responsive bypass valve includes a thermal motor mounted in a stationary position in the fluid-control housing to intercept engine coolant flowing through the fluid-transfer passageway, a coolant-flow blocker arranged to move between the foundation associated with the floor and ceiling of the fluid-control housing and formed to include a side wall arranged to surround the central axis and a top wall coupled to the side wall to define an interior chamber in communication with engine coolant in the upstream section of the fluid-transfer channel and at least one coolant-flow aperture communicating with the interior chamber and the radiator bypass passageway to define the interior passageway of the temperature-responsive bypass valve, and a piston arranged to engage the coolant-flow blocker and mounted for up-and-down movement along the central axis relative to the thermal motor to lower the coolant-flow blocker to a radiator-bypass position mating with the foundation associated with the floor of the fluid-control housing to cause flow of engine coolant from the upstream section of the fluid-transfer passageway to flow into the radiator bypass passageway via the interior chamber and coolant-flow aperture formed in the coolant-flow blocker without flowing directly from the upstream section of the fluid-transfer passageway to the downstream section of the fluid-transfer passageway at the first thermostat node and to raise the coolant-flow blocker away from the foundation associated with the floor to a radiator-supply position mating with a ceiling included in the fluid-control housing above and in spaced-apart relation to the foundation associated with the floor to block flow of engine coolant from the interior chamber into the radiator bypass passageway through the coolant-flow aperture and to all flow of engine coolant directly from the upstream section of the fluid-transfer passageway into the downstream section of the fluid-transfer passageway.

13. The fluid regulator of claim 10, wherein the fluid-control housing is formed to include an orifice coupling the radiator-bypass passageway and the radiator warm-up passageway and the radiator warm-up thermostat includes a temperature-responsive warm-up valve mounted for movement in the orifice to vary the flow of engine coolant from the radiator bypass passageway into the radiator warm-up passageway as temperature of engine coolant flowing through the orifice varies.

14. The fluid regulator of claim 13, wherein the radiator warm-up thermostat further includes an orifice insert mounted in a sealed position in the orifice and formed to include a coolant-conductor passageway extending therethrough in fluid communication with each of the radiator bypass passageway and radiator warm-up passageway and the temperature-responsive warm-up valve is arranged to move in the coolant-conductor passageway to define a variable-size annular channel through which the engine coolant flows from the radiator bypass passageway to the radiator warm-up passageway.

15. The fluid regulator of claim 14, wherein the orifice insert includes an upper collar formed to include a collar cavity receiving the temperature-responsive warm-up valve therein to define the variable-size annular channel between an exterior surface of the temperature-responsive warm-up valve and an interior surface of the upper collar and a lower collar coupled to the upper collar and formed to include at least one coolant-flow passageway arranged to interconnect the collar cavity and the radiator warm-up passageway in fluid communication.

16. The fluid regulator of claim 14, wherein the temperature-responsive warm-up valve includes a thermal motor and a piston having a free end rigidly coupled to a central portion of the orifice insert and fluidly coupled to the thermal motor and the thermal motor is arranged to extend into the coolant-conductor passageway formed in the orifice insert to define the variable-size annular channel therebetween and to move relative to the piston in response to changing temperature of engine coolant flowing in the coolant-conductor passageway to vary the size of the variable-size annular channel.

17. The fluid regulator of claim 16, wherein the radiator warm-up thermostat further includes a housing-mount cap coupled to the fluid-control housing, a movable spring perch located between the housing-mount cap and a spring seat included in the thermal motor, a valve-mover spring arranged to act against the housing-mount cap and a topside of the movable spring perch, and an over-travel spring arranged to act against an underside of the movable spring perch and the spring seat of the thermal motor normally to cooperate with the valve-mover spring and the spring perch.

18. The fluid regulator of claim 17, wherein the housing-mount cap is formed to include an annular seat arranged to face downwardly toward the topside of the spring perch and to engage the movable spring perch in response to upward movement of the thermal motor away from the orifice insert to allow further upward movement of the thermal motor to compress the over-travel spring between the now-stationary spring perch and the spring seat on the thermal motor.

* * * * *